US008899228B2

(12) United States Patent
Linton et al.

(10) Patent No.: US 8,899,228 B2
(45) Date of Patent: Dec. 2, 2014

(54) COMBINATION PRESSURE THERAPY FOR TREATMENT OF CHRONIC PAIN

(75) Inventors: Carl E. Linton, Temecula, CA (US); Allen Ruszkowski, San Jose, CA (US)

(73) Assignee: CVAC Systems, Inc., Temecula, CA (US)

( * ) Notice: Subject to any disclaimer, the term of this patent is extended or adjusted under 35 U.S.C. 154(b) by 0 days.

(21) Appl. No.: 13/213,982

(22) Filed: Aug. 19, 2011

(65) Prior Publication Data

US 2012/0080036 A1 Apr. 5, 2012

Related U.S. Application Data

(63) Continuation-in-part of application No. 13/011,058, filed on Jan. 21, 2011, which is a continuation of application No. 11/672,934, filed on Feb. 8, 2007, now abandoned, and a continuation-in-part of application No. 13/202,543, filed as application No. PCT/US2008/054923 on Feb. 25, 2008.

(60) Provisional application No. 60/771,848, filed on Feb. 8, 2006, provisional application No. 60/772,647, filed on Feb. 10, 2006, provisional application No. 60/773,460, filed on Feb. 15, 2006, provisional application No. 60/773,585, filed on Feb. 15, 2006, provisional application No. 60/774,441, filed on Feb. 17, 2006, provisional application No. 60/775,917, filed on Feb. 22, 2006, provisional application No. 60/775,521, filed on Feb. 21, 2006, provisional application No. 60/743,470, filed on Mar. 13, 2006, provisional application No. 60/745,721, filed on Apr. 26, 2006, provisional application No. 60/745,723, filed on Apr. 26, 2006, provisional application No. 60/824,890, filed on Sep. 7, 2006, provisional application No. 60/822,375, filed on Aug. 14, 2006, provisional application No. 60/826,061, filed on Sep. 18, 2006, provisional application No. 60/826,068, filed on Sep. 18, 2006, provisional application No. 60/891,696, filed on Feb. 26, 2007, provisional application No. 60/953,972, filed on Aug. 3, 2007, provisional application No. 60/953,973, filed on Aug. 3, 2007, provisional application No. 61/025,272, filed on Jan. 31, 2008.

(51) Int. Cl.
*A61G 10/02* (2006.01)
*A61H 99/00* (2006.01)

(52) U.S. Cl.
CPC ..... *A61G 10/023* (2013.01)
USPC ..... 128/202.12; 128/205.26

(58) Field of Classification Search
None
See application file for complete search history.

(56) References Cited

U.S. PATENT DOCUMENTS

| | | | |
|---|---|---|---|
| 3,073,040 | A | 1/1963 | Schueller |
| 4,227,524 | A | 10/1980 | Galerne |
| 4,427,385 | A | 1/1984 | Galerne |
| 4,678,438 | A | 7/1987 | Vykukal |
| 4,835,983 | A | 6/1989 | Chandler, Jr. et al. |
| 5,318,018 | A | 6/1994 | Puma et al. |
| 5,360,001 | A | 11/1994 | Brill et al. |
| 5,370,870 | A | 12/1994 | Wong |
| 5,467,764 | A | 11/1995 | Gamow |
| 5,490,784 | A | 2/1996 | Carmein et al. |
| 5,531,644 | A | 7/1996 | Marumo |
| 5,718,587 | A | 2/1998 | Sussingham |
| 6,565,624 | B2 | 5/2003 | Kutt et al. |
| 6,719,564 | B2 | 4/2004 | Than et al. |
| 6,899,103 | B1 | 5/2005 | Hood et al. |
| 2002/0035927 | A1 | 3/2002 | Kutt et al. |
| 2002/0083025 | A1 | 6/2002 | Robarts et al. |
| 2004/0006926 | A1 | 1/2004 | Neeley et al. |
| 2004/0112375 | A1 | 6/2004 | Boykin, Jr. |
| 2004/0180043 | A1 | 9/2004 | Sabbah et al. |
| 2004/0261796 | A1 | 12/2004 | Butler |
| 2005/0000520 | A1 | 1/2005 | Silman et al. |
| 2005/0008991 | A1 | 1/2005 | Hebert et al. |
| 2005/0026136 | A1 | 2/2005 | Weiss et al. |
| 2005/0056279 | A1 | 3/2005 | Linton |
| 2005/0056285 | A1 | 3/2005 | Harris |
| 2005/0261615 | A1 | 11/2005 | Weston |
| 2006/0147430 | A1 | 7/2006 | Sayre et al. |
| 2007/0184034 | A1 | 8/2007 | Linton |
| 2007/0193578 | A1 | 8/2007 | Linton et al. |
| 2007/0209668 | A1 | 9/2007 | Linton |
| 2012/0048284 | A1 | 3/2012 | Linton et al. |
| 2012/0073577 | A1 | 3/2012 | Linton et al. |

FOREIGN PATENT DOCUMENTS

| | | |
|---|---|---|
| JP | 60-232178 | 11/1985 |
| JP | 08-154982 A | 6/1996 |
| JP | 2003-310800 | 11/2003 |
| JP | 2004-202156 | 7/2004 |

(Continued)

OTHER PUBLICATIONS

Herbst et al, 2010. Journal of Pain Research. 3: 147-153.*

(Continued)

*Primary Examiner* — Zachary Howard

(57) ABSTRACT

A method according to an embodiments includes administering at least two Cyclic Variations in Altitude Condition (CVAC) sessions to a mammal disposed in a pressure vessel unit. The at least two CVAC sessions each have a duration of at least twenty minutes. The at least two CVAC sessions each include a start point of ambient pressure at a delivery site, an end point of ambient pressure at the delivery site, and a plurality of atmospheric pressure targets executed between the start point and the end point. The administering is configured to treat at least one of loss of sensation and chronic pain.

9 Claims, 32 Drawing Sheets

(56) References Cited

FOREIGN PATENT DOCUMENTS

| | | | | |
|---|---|---|---|---|
| WO | WO 2004/047710 | | 6/2004 | |
| WO | WO 2005/035068 | | 4/2005 | |
| WO | WO2008106410 | * | 9/2008 | ..... A61B 5/00 |

OTHER PUBLICATIONS

PTO-892, Notice of References Cited, from U.S. Appl. No. 10/659,997, Part of Paper No. 20070628.
International Search Report and Written Opinion for International Application No. PCT/US2004/21987 mailed Mar. 29, 2007.
Examiner's Report for Australian Patent Application No. 2007293561, mailed on Feb. 13, 2012.
Office Action for Chinese Patent Application No. 200780010115.7, dated Mar. 26, 2010; 7 pages.
Office Action for Chinese Patent Application No. 200780010115.7, dated Apr. 1, 2011.
Office Action for Chinese Patent Application No. 200780010115.7, dated Feb. 1, 2012.
Office Action for European Patent Application No. 07852349.5, dated Jan. 5, 2011; 4 pages.
Office Action for Korean Patent Application No. 10-2008-7021948, mailed on Aug. 29, 2013.
Office Action for U.S. Appl. No. 11/672,933, mailed on Jan. 16, 2009.
Final Office Action for U.S. Appl. No. 11/672,933, mailed on Jul. 24, 2009.
Office Action for U.S. Appl. No. 11/672,933, mailed on Dec. 29, 2011.
International Search Report for International Application No. PCT/US2007/003524, mailed on Sep. 8, 2008.
Written Opinion for International Application No. PCT/US2007/003524, mailed on Sep. 8, 2008.
Office Action for U.S. Appl. 11/672,937, mailed on Aug. 27, 2009.
Office Action for U.S. Appl. No. 11/672,937, mailed on Jul. 30, 2010.
Office Action for U.S. Appl. No. 11/672,937, mailed on Apr. 7, 2011.
Final Office Action for U.S. Appl. No. 13/011,058, mailed on Jun. 19, 2014.
Office Action for Australian Patent Application No. 2008219374, mailed on Jul. 16, 2012.
Supplementary European Search Report for European Patent Application No. EP 08730679, mailed on Dec. 1, 2011.
Office Action for European Patent Application No. 08730679.1, mailed on Sep. 4, 2012.
Office Action for Korean Patent Application No. 10-2009-7020178, dated Jun. 20, 2011.
Office Action for Korean Patent Application No. 10-2009-7020178, dated Mar. 29, 2012.
Office Action received for U.S. Appl. No. 13/202,543, mailed on Aug. 14, 2013.
Final Office Action received for U.S. Appl. No. 13/202,543, mailed on Apr. 17, 2014.
International Search Report for International Application No. PCT/US2008/054923, mailed Aug. 1, 2008.
International Search Report for International Application No. PCT/US2008/056999, mailed Aug. 18, 2008.
Abidia et al., "The Role of Hyperbaric Oxygen Therapy in Ischaemic Diabetic Lower Extremity Ulcers: a Double-blind Randomised-controlled Trial," Eur. J. Vasc, Endovasc. Surg., vol. 25, pp. 513-518 (2003).
Balestra et al., "Serum erythropoietin levels in healthy humans after a short period of normobaric and hyperbaric oxygen breathing: the "normobaric oxygen paradox"," Journal of Applied Physiology, vol. 100, pages 512-518 (2006).
Benelli, L., et al., "Endermologie: humoral repercussions and estrogen interaction," Aesthetic Plast. Surg., 23(5):312-315 (1999) (Abstract).
Bosco, C. et al., "Hormonal responses to whole-body vibration in men," Eur. J. Appl. Physiol., 81:449-454 (2000).
Brubaker et al., "Adventure Travel and Type I Diabetes: The Complicating Effects of High Altitude," Diabetes Care 28(10):2563-2572 (2005).
Chiu, L. L. et al., "Effect of prolonged intermittent hypoxia and exercise training on glucose tolerance and muscle GLUT4 protein expression in rats," J. Biomedical Sci., 11:838-846 (2004).
"CVAC Coupon," CVAC Advertisement, approximately Aug. 2002, San Diego CA.
CVAC Systems What's New [online] Dec. 1, 2002 [retrieved on Jun. 28, 2007]. Retrieved from Internet: http://web.archive.orgLweb/2002120 1231932/cvacsystems.comlWhat's+New.htm.
CVAC Systems What is CVAC? [online]. Dec. 1, 2002 [retrieved on Jun. 28, 2007]. Retrieved from Internet: http://web.archive.org/web120021201230242/cvacsystems.comlWhat+is+CVAC.htm.
CVAC Systems Background/Development [online], Dec. 1, 2002 [retrieved on Jun. 28, 2007]. Retrieved from Internet: http://web.archive.org/web/200212011914411cvacsystems.comiBackground.htm.
CVAC Systems Frequently Asked Questions [online]. Dec. 1, 2002 [retrieved on Jun. 28, 2007]. Retrieved from the Internet: http://web.archive.org. web/2002120 1230602/cvacsystems.comlCV AC+ F AQ.htm.
CVAC Systems Testimonials [online]. Feb. 14, 2003 [retrieved on Jun. 28, 2007]. Retrieved from the Internet: http:web.archive.org/web200302142314111 cvacsystems.com/testimonials.htm.
CVAC Systems Art [online]. Feb. 2, 2003 [retrieved on Jun. 28, 2007]. Retrieved from the Internet: http://web. archive. org/web/2003 0203 5 5 847/ cvacsysterns .comltestimonialsart.htrn.
Ding, X. M. et al., "Neuroprotective effect of exogenous vascular endothelial growth factor on rat spinal cord neurons in vitro hypoxia," Chin. Med. J. (Engl), 118(19):1644-1650 (2005).
Eckardt, K. U. et al. "Regulation of erythropoietin production," Eur. J. Clin. Invest, 35 (Supp, 3):13-19, (2005) (Abstract).
Eid, T. et al., "Recombinant human erythropoietin for neuroprotection: what is the evidence?," (Clin. Breast Cancer, 3 Suppl. 3:3109-S115, Dec. 2002 (Abstract).
Elton, S., "CVAC: The Next Wave in Altitude Training," http://www.trinewbies.com, cited on http://web.archive.org between Jun. 5, 2002 and Aug. 6, 2002.
Fuller, D. et al., "Synaptic Pathways to Phrenic Motoneurons Are Enhanced by Chronic Intermittent Hypoxia after Cervical Spinal Cord Injury," J. Neurosci., 23(7):2993-3000, Apr. 1, 2003.
Golder, F. J. et al., "Spinal synaptic enhancement with acute intermittent hypoxia improves respiratory function after chronic cervical spinal cord injury," J. Neurosci. 25(11)2925-32, Mar. 16, 2005.
Gutsaeva, D. R. et al., "Transient hypoxia stimulates mitochondrial biogenesis in brain subcortex by a neuronal nitric oxide synthase-dependent mechanism," The Journal of Neuroscience, 28(9):2015-2024 (2008).
Heinicke, K. et al., "Long-term exposure to intermittent hypoxia results in increased hemoglobin mass, reduced plasma volume, and elevated erythropoietin plasma levels in man," Eur, J. Appl, Physiol., 88(6):535-43 (2003) (Abstract).
Hetzler, R. K., et al., "The Effect of Dynamic Intermittent Hypoxic Conditioning on Arterial Oxygen Saturation", Wilderness and Environmental medicine, vol. 20, 2009, pp. 26-32.
Hu et al., "Comparisons of serum testosterone and corticosterone between exercise training during normoxia and hypobaric hypoxia in rats," Eur. J. Applied Physiol. 78(5):417-421 (1998) (Abstract).
"Introducing CVAC," CVAC press release; approximately Jan. 2002, San Diego CA.
"Introducing the CVAC Process,", CVAC press release, approximately Nov. 2001, San Diego CA.
Kanagy et al,, "Role of Endothelin in Intermittent Hypoxia-Induced Hypertension," Hypertension, vol.37, pp. 511-515 (2001).
Kiernan, T. J. et al., "Effect of enhanced external counterpulsation on circulating CD34+ progenitor cell subsets," International Journal of Cardiology (2010), doi:10,1016/j.ijcard.2010.08.020.
Kirby, M., "Negative pressure wound therapy", The British Journal of Diabetes And Vascular Disease, vol. 7, Issue 5, Sep./Oct. 2007; pp. 230-234.
Linton, C., "Kiosk Rental Letter," Letter, approximately May 2002, San Diego CA.

(56) References Cited

OTHER PUBLICATIONS

Makley, J. T. et al,, "The Effect of Reduced Barometric Pressure on Fracture Healing in Rats", The Journal of Bone and Joint Surgery, vol. 49-A, No, 5, Jul. 1967; pp. 903-914.
Marquez, J. L. et al., "Cyclic Hypobaric Hypoxia Improves Markers of Glucose Metabolism in Middle-Aged Men", High Altitude Medicine & Biology, vol. 14, No. 3, 2013; pp. 263-272.
Morino, K, et al., "Reduced mitochondrial density and increased IRS-1 serine phosphorylation in muscle of insulin-resistant offspring of type 2 diabetic parents," The Journal of Clinical Investigation, 115(12):3587-3593 (2005).
"New & Exciting Adventure in Exercise," CVAC Press Release, Approximately Oct. 2001, San Diego CA.
Pavan et al., "Metabolic and Cardiovascular Parameters in Type I Diabetes at Extreme Altitude," Med, Sci. Sports Exerc. 36(8):1283-1289 (2004).
Reid, W., "Devce Enhances Performances for Local Athletes," http://www.SignOnSanDiego.com, Aug. 25, 2002.
Rodriguez et al., "Erythropoietin acute reaction and haematological adaptations to short, intermittent hypobaric hypoxia", 2000. Eur J Appl Physiol. 82: 170-177.
Schmidt et al, "Effects of Intermittent Exposure to High Altitude on Blood Volume and Erythropoietin Activity," 2002. High Altitude Medicine & Biology. 3(3): 167-176).
Sen, C. K., "Wound healing essentials: Let there be oxygen", Wound Repair and Regeneration, vol. 17, 2009; pp. 1-18.
Sharp, F. et al, "Hypoxic Preconditioning Protects against Ischemic Brain Injury," NeuroRx: J. Am. Soc. Exp. Neuro., vol. 1;26-35 (2004).
Singh et al., "High Variability of Glycated Hemoglobin Concentrations in Patients with IDDM Followed Over 9 Years," Diabetes Care 20(3):306-308 (1997).
Tin'Kov et al., "Effects of intermittent hypobaric hypoxia on blood lipid concentrations in male coronary heart disease patients," High Altitude Medicine & Biology, 3(3):277-282 (2002).
Viscor, G, et al., "Combined intermittent hypoxia and surface muscle electrostimulation as a method to increase peripheral blood progenitor cell concentration," Journal of Translational Medicine, 7:91-96 (2009).
Xiaowei, H, et al., "The experimental study of hypoxia-inducible factor-1α and its target genes in spinal cord injury," Spinal Cord, 44(1):35-43 Jan. 2006.

* cited by examiner

| Subject | Age | Sex | CVAC Exposure Summer 2007 | CVAC Exposure Fall 2007 | Total chol. | Tri. | HDL | VLDL | LDL | Total chol. | Tri. | HDL | VLDL | LDL | Total chol. | Tri. | HDL | VLDL | LDL |
|---|---|---|---|---|---|---|---|---|---|---|---|---|---|---|---|---|---|---|---|
| S-1 | 45 | M | None | Sham | 209 | 224 | 43 | 45 | 121 | 193 | 289 | 41 | 58 | 94 | -16 | 65 | -2 | 13 | -27 |
| S-3 | 70 | M | None | CVAC | 165 | 107 | 50 | 21 | 94 | 166 | 84 | 47 | 17 | 102 | 1 | -23 | -3 | -4 | 8 |
| S-6 | 25 | F | None | CVAC | 140 | 64 | 57 | 13 | 70 | 190 | 70 | 66 | 14 | 110 | 50 | 6 | 9 | 1 | 40 |
| M-9 | 37 | M | CVAC | CVAC | 158 | 36 | 49 | 7 | 102 | 164 | 66 | 40 | 13 | 111 | 6 | 30 | -9 | 6 | 9 |
| M-18 | 28 | M | CVAC | CVAC | 177 | 90 | 59 | 18 | 100 | 165 | 96 | 51 | 19 | 95 | -12 | 6 | -8 | 1 | -5 |
| M-23 | 60 | M | Sham | CVAC | 201 | 132 | 42 | 26 | 133 | 214 | 164 | 50 | 33 | 131 | 13 | 32 | 8 | 7 | -2 |
| M-14 | 49 | M | None | None | 187 | 63 | 65 | 13 | 109 | 173 | 76 | 52 | 15 | 106 | -14 | 13 | -13 | 2 | -3 |

FIG. 2

| | | | | | TOTAL SERUM TESTOSTERONE SEPT. TO DEC. 2007 | | | | SERUM FREE TESTOSTERONE SEPT. TO DEC. 2007 | | | | RATIO OF SERUM FREE TESTOSTERONE TO TOTAL TESTOSTERONE SEPT. TO DEC. 2007 | | | |
|---|---|---|---|---|---|---|---|---|---|---|---|---|---|---|---|---|
| Subject | Age | Sex | CVAC Exposure Summer 2007 | CVAC Exposure Fall 2007 | Sept. | Dec. | Diff. | % Diff. | Sept. | Dec. | Diff. | % Diff. | Sept. | Dec. | Diff. | % Diff. |
| S-1 | 45 | M | None | Sham | 355 | 316 | -39 | -11% | 15.97 | 15.52 | -0.45 | -3% | 4.5 | 4.91 | 0.41 | 9% |
| S-3 | 70 | M | None | CVAC | 573 | 746 | 173 | 30% | 15.64 | 14.55 | -1.09 | -7% | 2.73 | 1.95 | -0.78 | -29% |
| S-6 | 25 | F | None | CVAC | 43 | 70 | 27 | 63% | 0.7 | 1.29 | 0.59 | 84% | 1.63 | 1.84 | 0.21 | 13% |
| M-9 | 37 | M | CVAC | CVAC | 365 | 566 | 201 | 55% | 10.57 | 23.26 | 12.69 | 120% | 2.97 | 4.11 | 1.14 | 38% |
| M-18 | 28 | M | CVAC | CVAC | 656 | 799 | 143 | 22% | 30.57 | 31.8 | 1.23 | 4% | 4.66 | 3.98 | -0.68 | -15% |
| M-23 | 60 | M | Sham | CVAC | 475 | 505 | 30 | 6% | 10.5 | 15.4 | 4.9 | 47% | 2.21 | 3.05 | 0.84 | 38% |
| M-14 | 49 | M | None | None | 866 | 841 | -25 | -3% | 17.06 | 17.07 | 0.01 | 0% | 1.97 | 2.03 | 0.06 | 3% |

FIG. 3

SHAM/PLACEBO

SHAM/PLACEBO

SHAM/PLACEBO

COMBINATION PRESSURE THERAPY FOR TREATMENT OF CHRONIC PAIN

CROSS-REFERENCE TO RELATED APPLICATIONS

This application is a continuation-in-part of U.S. patent application Ser. No. 13/011,058, filed Jan. 21, 2011, entitled "Combination Pressure Therapy for Treatment of Ischemia and Heart Conditions, Diabetes, Alzheimer's Disease and Cancer," which is a continuation of U.S. patent application Ser. No. 11/672,934, filed Feb. 8, 2007, which claims the benefit of U.S. Provisional Application No. 60/771,848, filed Feb. 8, 2006, U.S. Provisional Application No. 60/772,647, filed Feb. 10, 2006, U.S. Provisional Application No. 60/773,460, filed Feb. 15, 2006, U.S. Provisional Application No. 60/773,585, filed Feb. 15, 2006, U.S. Provisional Application No. 60/774,441, filed Feb. 17, 2006, U.S. Provisional Application No. 60/775,917, filed Feb. 22, 2006, U.S. Provisional Application No. 60/775,521, filed Feb. 21, 2006, U.S. Provisional Application No. 60/743,470, filed Mar. 13, 2006, U.S. Provisional Application No. 60/745,721, filed Apr. 26, 2006, U.S. Provisional Application No. 60/745,723, filed Apr. 26, 2006, U.S. Provisional Application No. 60/824,890, filed Sep. 7, 2006, U.S. Provisional Application No. 60/822,375, filed Aug. 14, 2006, U.S. Provisional Application No. 60/826,061, filed Sep. 18, 2006, and U.S. Provisional Application No. 60/826,068, filed Sep. 18, 2006, which applications are incorporated herein by reference. This application is also a continuation-in-part of U.S. patent application Ser. No. 13/202,543, filed Aug. 19, 2011, entitled "Combination Pressure Therapy for Treatment of Serum Lipid Levels, Steroid Levels, and Steroidogenesis," which is a national staged entry under 35 U.S.C. §371 of International Patent Application No. PCT/US2008/054923, filed Feb. 25, 2008, entitled "Combination Pressure Therapy for Treatment of Serum Lipid Levels, Steroid Levels, and Steroidogenesis," which claims the benefit of U.S. Provisional Application No. 60/891,696, filed Feb. 26, 2007, entitled "Combination Pressure Therapy for Treatment of Serum Lipid Levels, Steroid Levels, and Steroidogenesis," U.S. Provisional Application No. 60/953,972, filed Aug. 3, 2007, entitled "Combination Pressure Therapy for Treatment of Serum Lipid Levels, Steroid Levels, and Steroidogenesis Associated with HIV Infection," U.S. Provisional Application No. 60/953,973, filed Aug. 3, 2007, entitled "Combination Pressure Therapy for Treatment of Serum Lipid Levels, Steroid Levels, and Steroidogenesis," U.S. Provisional Application No. 61/025,272, filed Jan. 31, 2008, entitled "Combination Pressure Therapy for Treatment of Serum Lipid Levels, Steroid Levels, and Steroidogenesis Associated with HIV Infection, " which applications are incorporated herein by reference.

BACKGROUND

Hyperlipidemia, hyperlipoproteinemia or dyslipidemia is the presence of elevated or abnormal levels of lipids and/or lipoproteins in the blood. Lipids (fatty molecules) are transported through and around the body in the blood. Easily recognizable categories of these lipids include low-density lipoproteins, high-density lipoproteins, and cholesterol. Lipid and lipoprotein abnormalities are extremely common in the general population, and are regarded as a highly modifiable risk factor for cardiovascular disease due to the influence of cholesterol, one of the most clinically relevant lipid substances, on atherosclerosis.

Hyperlipidemia becomes most seriously symptomatic when interfering with the coronary circulation supplying the heart or cerebral circulation supplying the brain, and is considered the most important underlying cause of strokes, heart attacks, various heart diseases including congestive heart failure and most cardiovascular diseases in general. Atheroma in the arm, or more often leg, arteries often produces decreased blood flow and is called peripheral artery occlusive disease (PAOD).

Cholesterol is also the main building block of in the process of steroidogenesis. Steroidogenesis involves the synthesis of steroid compounds, including the hormones testosterone and estrogen, as well as mineralocorticoids and glucocorticoids. Dysregulation of steroid and hormone synthesis results in detrimental effects on men and women. For example, dysregulation of testosterone can result in changes in body composition, increases in fat mass, and decreases in lean body mass. [Kupelian, V. et al., *Low Sex Hormone-Binding Globulin, Total Testosterone, and Symptomatic Androgen Deficiency are Associated with Development of the Metabolic Syndrome in Non-Obese Men*, J. Clin. Endocdr. & Metabol., 91(3): 843-50 (2007).] Similar problems occur in women, and hormone dysregulation related to estrogens and menopause is well documented. Thus, steroidogenesis and hormone dysregulation are a continuing health problem.

Additionally, infection with the human immunodeficiency virus ("HIV") can have complications such as dysregulation of steroidogenesis. Androgen deficiency is known to be prevalent among HIV-infected men with low weight and wasting. Initial estimates demonstrated that androgen deficiency occurs in 50% of men with AIDS-related wasting, and more recently has been shown to be present in, on average, 20% of men who receive highly active antiretroviral therapy ("HAART"). Similarly, testosterone levels are reduced among women with HIV disease as compared with levels in age- and sex-matched control subjects. [Steven Grinspoon, *Androgen Deficiency and HIV Infection*, Clin. Infect. Diseases, 41; 1804-05 (2005).]

Abnormalities in the process of steroidogenesis (including the modulation of steroid levels) are commonly treated with pharmaceuticals. Examples of such pharmaceuticals include, but are not limited to, supplemental testosterone, estrogens, and other hormones. There is a need for alternative therapies for the modulation of steroidogenesis and serum lipid levels. There is also a need for modulation of steroid levels in HIV infected individuals.

Chronic pain, which can be characterized as pain that extends beyond an expected period of healing (e.g., such as more than three or six months), is a widespread health problem that affects millions of people. Types of chronic pain include headaches, back or neck pain, arthritis pain, carpal tunnel syndrome, fibromyalgia/fibrosis, myofascial pain, neuropathy and neuralgia pain, phantom limb pain, reflexive sympathetic dystrophy syndrome, and pain or other discomfort associated with bowel disorders (e.g., constipation), among others. In some cases, chronic pain results from an illness or condition such as, for example, adiposis dolorosa, diabetes, osteoporosis, lupus, rheumatoid arthritis, scoliosis, endometriosis, scleroderma, disturbances in the sympathetic and parasympathetic nervous systems, and bowel disorders (e.g., constipation). In many cases, however, the underlying cause of a person's chronic pain is unknown.

Known treatment methods for chronic pain generally include using pharmaceutical pain relievers, such as acetaminophen or nonsteroidal anti-inflammatory drugs (NSAIDs), changes to diet, exercise, and/or sleep habits, and complementary medicine therapies, such as acupuncture, massage, or meditation. Such traditional pain treatment methods, however, often fail to provide adequate relief to sufferers of chronic pain.

Another known treatment for decreasing pain associated with neuropathy (such as diabetic neuropathy) includes the use of a hypobaric chamber for subjecting an arm or leg of a user to a vacuum. In use, the user places the desired body part through a port and into a hollow chamber of the device. A seal is inflated between the device and the body part, then pressure within the hollow chamber is adjusted by a physician to a desired level. Use of such a hypobaric treatment device is inefficient, however, because it is limited to treatment of a single body part per session, it does not provide for multiple and/or varying pressures throughout a session, and also because it requires the presence of a physician or other healthcare practitioner during the treatment session.

As such, there is also a need for improved chronic pain treatment methods, including improved methods for the treatment of chronic pain using whole body hypobaric or hypoxic conditioning and/or vaso-pneumatic compression that utilizes multiple and/or varying pressures throughout a treatment session and that can be executed without direct physician supervision. Additionally, such an improved method will maximize beneficial effects associated with hypobaric conditioning within short treatment periods that do not lead to the detrimental effects of such conditioning as found with current methods of static hypobaric conditioning.

SUMMARY

The invention generally relates to the use of air pressure therapy for the treatment and prevention of diseases, conditions, and disorders, and more specifically to the treatment of loss of sensation and/or chronic pain using hypoxic conditioning and/or total body vaso-pneumatic compression. Methods according to embodiments provide for administering pressure changes to a user for the treatment of chronic pain. Treatment as used herein includes application of the disclosed methodologies for prevention, prophylactic treatment, current treatment, amelioration, alleviation and/or recovery of the disease, condition, or disorder.

One aspect of the invention is the administration of at least two Cyclic Variations in Altitude Conditioning ("CVAC") sessions for the treatment of chronic pain. CVAC sessions may be administered in defined intervals or at random occurrences. In one embodiment, at least one CVAC session is administered for the alleviation of chronic pain associated with diabetic neuropathy. In one embodiment, at least one CVAC session is administered for the alleviation of chronic pain associated with fibromyalgia. In one embodiment, at least one CVAC session is administered for the alleviation of chronic pain associated with adiposis dolorosa.

A CVAC session includes a set of targets which are pressures found in the natural atmosphere. A CVAC session includes start and end points and more than one target which are executed between the start and end points. These targets are delivered in a precise order, and are executed in a variety of patterns including, but not limited to, cyclic, repeating, and/or linear variations. The starting points and ending points in any CVAC session are preferably the ambient pressure at the delivery site. The targets inherent in any CVAC session are connected or joined together by defined transitions. These transitions can include rises and/or falls in pressure, or a combination thereof. Additional targets which modulate time, temperature, or humidity are also run concurrently, sequentially, or at other intervals with the pressure targets when such additional targets and conditions are desired.

In some embodiments, one or more targets of a CVAC session can include pressure, temperature, time, and/or humidity parameters. Parameters of targets and sessions can be customized to individual needs. In some embodiments, one or more CVAC sessions are administered in combination with pharmaceutical regimens for the treatment of chronic pain.

BRIEF DESCRIPTION OF THE DRAWINGS

FIG. 2 depicts a chart summarizing the serum lipid levels from 7 subjects following treatment with CVAC sessions. Total cholesterol, triglycerides, HDL, VLDL, and LDL levels are represented prior to and following administration of CVAC sessions for 40 minutes, twice a week throughout the study period.

FIG. 3 depicts a chart summarizing testosterone levels from 7 subjects following treatment with CVAC sessions. Total testosterone, free testosterone, and ratios of free testosterone to total testosterone are represented prior to and following administration of CVAC sessions for 40 minutes, twice a week throughout the study period.

DETAILED DESCRIPTION

Figure 1A:
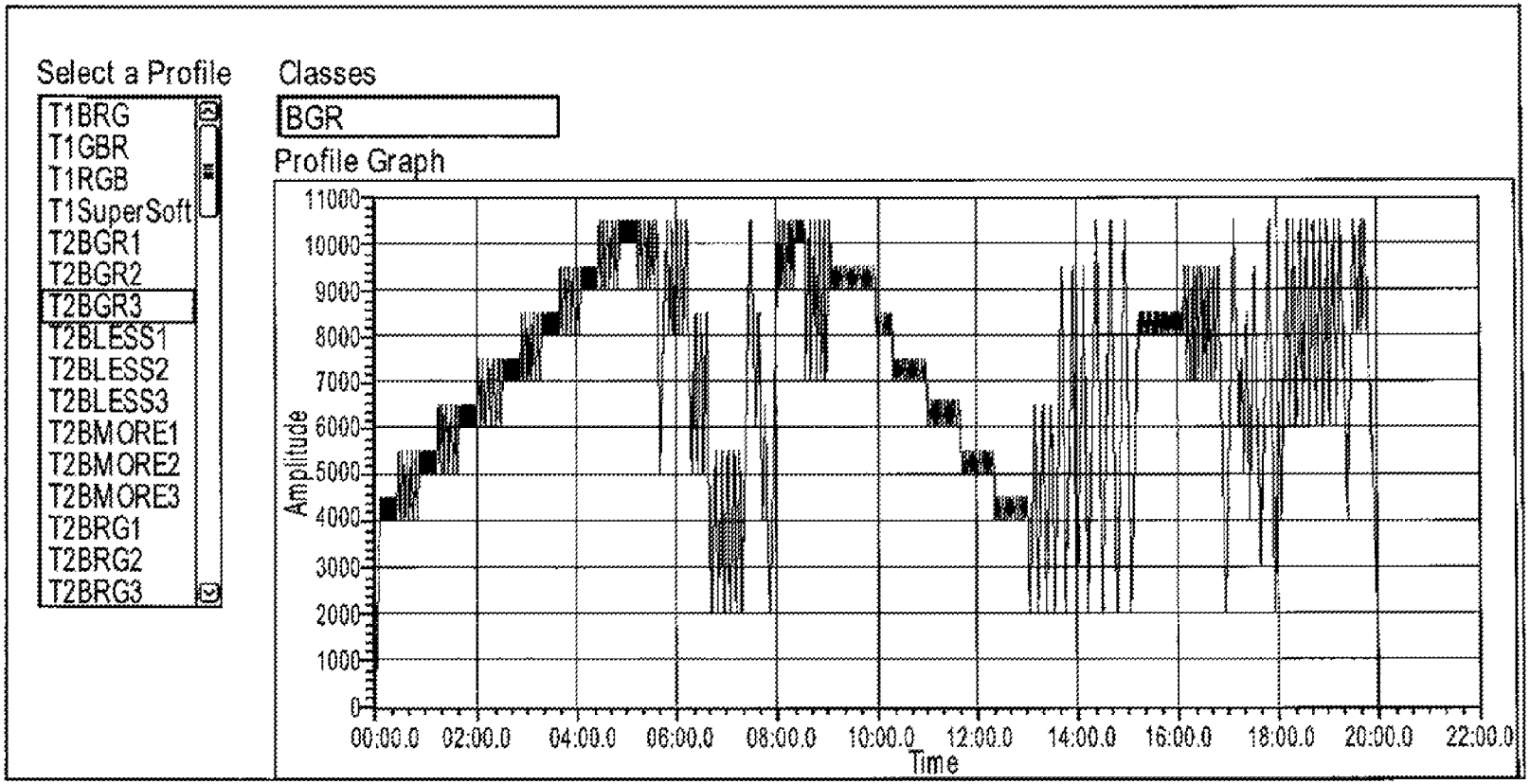
FIG. 1A is a graphical illustration of various pressures applied over time for a selected CVAC session profile according to an embodiment. The Y-axis represents atmospheric pressure levels and the X-axis represents time. The varying pressures, as indicated by the changes in values on the Y-axis, were applied for various lengths of time, as indicated by changes values on the X-axis. The exemplary CVAC session depicted in FIG. 1A was 20 minutes in length.

As described in International Patent Appl. No. PCT/US2008/054923 to Linton et al., filed Feb. 25, 2008, and entitled, "Combination Pressure Therapy for Treatment of Serum Lipid Levels, Steroid Levels, and Steroidogenesis," the entire disclosure of which is incorporated herein by reference, while oxygen deprivation of the body or specific tissues can cause tissue damage, and even death, controlled deprivation of oxygen to the body and/or specific tissues has been shown to be beneficial when imposed for specific periods of time under particular conditions. In practice, most current hypoxic conditioning protocols utilize static pressures for blocks of time ranging from 30 minutes to an hour or more to achieve the desired and reported responses. Hypoxic conditioning may be provided by decreased oxygen levels in the atmosphere or by a reduction in atmospheric pressure (hypobaric conditions), thus reducing the availability of oxygen for efficient respiration. Both methods can provide beneficial results including protection of tissues from damage due to injury and ischemia.

Moderate static hypoxic preconditioning is known to provide protection from ischemic damage via tolerance. When the environmental oxygen levels are reduced (hypoxia), downstream effects include protection from damage due to subsequent hypoxia. [Sharp, F., et al., Hypoxic Preconditioning Protects against Ischemic Brain Injury, NeuroRx: J. Am. Soc. Exp. Neuro., Vol. 1: 26-25 (2004)]. This tolerance is not yet completely understood, but it has been linked to various cellular mechanisms and molecules, including, but not limited to, molecules such as erythropoietin (EPO), hypoxia-inducible factor (HIF), Tumor Necrosis Factor (TNF), glycogen, lactate, and others. [Sharp, F., et al., Hypoxic Preconditioning Protects against Ischemic Brain Injury, NeuroRx: J. Am. Soc. Exp. Neuro., Vol. 1: 26-25 (2004)]. Additionally, beneficial static hypoxic conditioning is not purely additive. Administration of sequential sessions can have detrimental effects. Oxygen concentrations that are too low result in detrimental effects to the tissues as well as the entire body. Similarly, hypoxic conditioning of longer durations can have detrimental effects in addition to providing some desired beneficial effects [Sharp, F., et al., Hypoxic Preconditioning Protects against Ischemic Brain Injury, NeuroRx: 1. Am. Soc. Exp. Neuro., Vol. 1: 26-25 (2004)].

Initial understanding in the art about the effects of hypoxia focused on increased oxygenation of the blood via increased production of red blood cells mediated by increases in EPO production. While increases in EPO production are believed to increase red blood cell production, its effects are not limited to this activity. Additional studies also show protective activity for EPO in white and gray matter (brain and spinal cord tissue), inflammatory and demyelinating conditions, and other various ischemic events. [Eid, T. and Brines, M., Recombinant human erythropoietin for neuroprotection: what is the evidence?, Clin. Breast Cancer, 3 Suppl. 3:S109-15, Dec. 2002]. Furthermore, molecules such as HIF, induced by hypoxia, regulate EPO production in addition to a variety of other activities including metabolism, angiogenesis, and vascular tone—the stimulation of which may all play a role in protecting tissue from subsequent hypoxic damage both prophylactically and post-ischemic or traumatic events. [Eckardt K U, Kurtz, A., Regulation of erythropoietin production, Eur. J. Clin. Invest., (Supp. 3):13-19, (2005)]. Vascular endothelial growth factor (VEGF) is a known hypoxia induced protein under the control of HIF-1a. VEGF has been shown to have direct neuroprotective effects on mammalian spinal cord neurons following spinal cord injury. [Ding X M, et al., Neuroprotective effect of exogenous vascular endothelial growth factor on rat spinal cord neurons in vitro hypoxia, Chin. Med. I (Engl), 118(19):1644-50, Oct. 5, 2005].

Static hypoxic therapy for extended durations of time has been shown to significantly reduce total cholesterol, LDL, very low-density lipoprotein (VLDL), as well as increase HDL. Thus, the overall serum lipid profile was also significantly reduced. [Tin'Kov, A. N. and Aksenov, V. A., Effects of Intermittent Hypobaric Hypoxia on Blood Lipid Concentrations in Male Coronary Heart Disease Patients, High Alt. Med. & Biol., 3(3): 277-282 (2002)]. Type 2 Diabetes has been regarded as a relatively distinct disease entity, but recent understanding has revealed that Type 2 Diabetes (and its associated hyperglycemia or dysglycemia) is often a manifestation of a much broader underlying disorder, which includes metabolic syndrome. This syndrome may also be referred to as Syndrome X, and is a cluster of cardiovascular disease risk factors that, in addition to glucose intolerance, includes hyperinsulinaemia, dyslipidaemia, hypertension, visceral obesity, hypercoagulability, and micro albuminuria. Provided herein are methods of treating metabolic syndrome and/or insulin resistance. In one embodiment, metabolic syndrome is treated by modulation of testosterone levels via application of at least one CVAC session.

Alternative therapies such as oxygen deprivation are known to provide some beneficial effect as well. While oxygen deprivation of the body or specific tissues can cause tissue damage, and even death, controlled deprivation of oxygen to the body or specific tissues or a combination thereof has been shown to be beneficial when imposed for specific periods of time under particular conditions. Hypoxic conditioning may be provided by decreased oxygen levels in the atmosphere or by a reduction in atmospheric pressure (hypobaric conditions), thus reducing the availability of oxygen for efficient respiration. Both methods can provide beneficial results including prevention of damage due to inflammation and swelling. However, all current forms of hypoxic conditioning involve applications of static pressures and involve relatively long periods of application.

Additionally, application of physical energy or force to the body through relatively low levels vibrational therapy has been linked to increases in steroidogenesis, [Bosco, C. et al., Hormonal responses to whole-body vibration in men, Eur. I. Appl. Physiol., 81: 449-454 (2000)], and application of physical force to the epidermal layers of the skin through endermologie has also been shown to modulate estradiol (an estrogen) levels in women. [Benelli, L., et al., Enderrnologie: humoral repercussions and estrogen interaction, Aesthetic Plast. Surg. 23(5): 312-15 (1999)].

There is a high prevalence of low testosterone levels in HIV-infected individuals, and 20-25% of HIV-infected men who receive highly active antiretroviral therapy (HAART) also suffer from reduce testosterone levels. Furthermore, low testosterone levels are associated with weight loss, progression to AIDS, wasting, depression and loss of muscle mass. [Bahsin et al., *Testosterone Therapy in Adult Men with Androgen Deficiency Syndromes: An Endocrine Society Clinical Practice Guideline*, I. elin. Endocrin. & Metab., 91(6): 1995-2010 (2006); Arver et al., *Serum Dihydrotestosterone and testosterone concentrations in Human Immunodeficiency Virus-infected men with and without weight loss*, J. Andrology, 20(5):611-618 (1999)]. Testosterone therapy in HIV-infected individuals is known to improve weight gain, improve muscle strength, and provide gains in lean-body mass. Provided herein are methods for modulating steroidogenesis in HIV-infected individuals. In one non-limiting example, administration of at least one CVAC session to an HIV-infected individual increases testosterone levels in the HIV-infected individual.

Abnormalities in serum lipid levels and the process of steroidogenesis (including the modulation of steroid levels) are commonly treated with pharmaceuticals. Examples of such pharmaceuticals include, but are not limited to, Lipitor®, Zocor®, Vytorin®, and other statins as well as supplemental testosterone, estrogens, and other hormones. There is a need for alternative therapies for modulation of serum lipid levels, the modulation of steroidogenesis, and the modulation of steroid levels.

Further there is a need for such therapies without the potential negative side-effects of pharmaceutical regimens. Alternatively, there is a need for such therapies that could lessen the negative side-effects of pharmaceutical regimens by altering pharmaceutical regimens, could work beneficially with pharmaceutical regimens, or could work synergistically when used in combination with pharmaceutical regimens. There is a further need for hypobaric or hypoxic conditioning which maximizes the beneficial effects within short treatment periods that do not lead to the detrimental effects of such conditioning as found with current methods of static hypobaric conditioning. There is a further need for such hypobaric or hypoxic conditioning that utilizes multiple and/or varying pressures throughout the conditioning. There is yet a further need for hypobaric or hypoxic conditioning that incorporates vaso-pneumatic effects in addition to the hypoxic considerations.

The invention disclosed herein may provide for such needs and may do so in a manner unique and generally advantageous compared to all previous forms of hypobaric conditioning. Similarly, the invention disclosed herein can provide for vaso-pneumatic effects in a manner both unique and generally advantageous to previous vibrational therapies and endermologie. Additionally, CVAC sessions can provide for vaso-pneumatic beneficial effects. Although not limited, CVAC sessions are believed to act like a vaso-pneumatic pump on the user's body, thus stimulating flow of fluids in the body, including but not limited to blood and lymphatic fluids. The negative and positive pressures imposed by the CVAC session can affect the fluid flow or movement within a body, thus improving the delivery of beneficial nutrients, immune factors, blood, and oxygen while also improving the removal of harmful toxins, fluids, and damaged cells or tissues. Furthermore, the vaso-pneumatic effects generated during any given CVAC session can exert pressures on the body and tissues of a user. CVAC can also provide similar application of force and/or transfer of mechanical energy into the cells and tissue of a user via vaso-pneumatic pressure. However, CVAC sessions provide for a novel and unique application of varying pressure changes and times superior to the static application of force described previously, thus providing the beneficial effects of physical forces in a novel and generally advantageous way. By use of the present invention, CVAC sessions can modulate steroid levels and/or steroidogenesis in a subject. Examples of steroids modulated include, but are not limited to, testosterone and estrogen, The combination of the beneficial effects of CVAC sessions results in treatment and modulation of serum lipids and/or the modulation of steroidogenesis and steroid levels, including all the aforementioned aspects and embodiments.

Methods of using air pressure therapy for the treatment and prevention of diseases and conditions, and, more specifically, using whole body hypobaric conditioning and/or whole body vaso-pneumatic compression for the treatment of loss of sensation and/or chronic pain, are also disclosed herein. As used herein, "chronic pain" refers to pain that occurs over an extended duration (e.g., at least about three or six months) and can include, but is not limited to, headaches, back or neck pain, arthritis pain, carpal tunnel syndrome, fibromyalgia/fibrosis, myofascial pain, neuropathy and neuralgia pain, phantom limb pain. Chronic pain can also include pain associated with an illness or condition such as, for example, adiposis dolorosa, diabetes, osteoporosis, lupus, rheumatoid arthritis, scoliosis, endometriosis, and scleroderma. Such methods can include the use of whole body cyclic pneumatic hypobaric compression for the treatment of chronic pain associated with a specific condition, including, for example, diabetic neuropathy, such as diabetic peripheral neuropathy, fibromyalgia, and/or adiposis dolorosa.

A pressure vessel unit (PVU) is a system for facilitating pressure changes accurately and quickly in the environment surrounding a user. A PVU can provide both reduced and increased atmospheric pressures. An example of a unique PVU and associated methods for controlling the pressure within such a PVU are described in U.S. patent application Ser. No. 10/659,997 to Carl. E. Linton, filed Sep. 11, 2003, entitled "Methods and Apparatus for Cyclic Variations in Altitude Conditioning," ("the '997 application") which is incorporated herein by reference in its entirety. A variety of PVUs may be used in conjunction with the methods disclosed herein, including but not limited to those described in the '997 application, and other suitable pressure units or chambers will be known to those of skill in the art and can be adapted for use with the disclosed methodologies.

Methodology of the Cyclic Variations in Altitude Conditioning (CVAC) Program: The methodologies according to embodiments for whole body hypobaric conditioning and/or whole body vaso-pneumatic compression encompass executing a CVAC Program including a set of pressure targets with defined transitions. Additional targets can be included such as temperature or humidity, and these targets can be implemented concurrently, prior to, or subsequent to the pressure targets. The permutations of targets are customizable to the individual and condition to be treated. Some of the terms relating to this methodology are defined below for a better understanding of the methodology as used in the context of the present invention.

A CVAC Program: Every user will respond in a unique manner to changes in air pressure, temperature and oxygen levels that occur during cyclic variations in altitude conditioning. This necessitates a customized approach to delivering a highly effective and efficacious CVAC program to each user. The CVAC program includes a set of sessions, which are administered to the user as a serial round or cycle. This means that a user may have a session that they start and repeat a given number of times and then proceed to the next scheduled session which will be repeated a given number of times. A program may contain a set of one or more sessions, each of which can have a repetition schedule. The sessions are can be delivered in a scheduled order, which repeats itself like a loop such that the user is administered one session at a time for a specified number of times. The user may then be administered the next scheduled session a specified number of times. This process can be repeated until the user is administered the last element of the scheduled sessions set. When the requisite repetitions have been accomplished, the process can repeat itself beginning at the first element of the scheduled sessions set. A session or groups of sessions may be repeated multiple times before changing to a subsequent session or group of sessions, however, sessions may also be administered as few as one time before beginning the next session in the sequence. Subsequent sessions can contain targets that are identical to the previous session, or they can implement new permutations of desired targets. The combination of sessions and targets within sessions is customizable based on the desired physiological outcome and assessment of the user. Alternatively, a user may also modulate the parameters of a CVAC session, in certain embodiments from within the unit, thus providing for real-time user feedback and alterations. As used in reference to a parameter of a CVAC session, modulation includes any changes, positive and negative, made to the parameters of the CVAC session. The parameters are described herein. This comprises a Cyclic Variations in Altitude Conditioning (CVAC) Program.

A CVAC Session: A CVAC Session comprises of a set of targets which are multiple atmospheric pressures, and a CVAC session includes start and end points, and more than one target which is executed between the start and end points. These targets are delivered in an order that may vary and are executed in a variety of patterns including, but not limited to, cyclic, repeating, and/or linear variations. When a target is executed as contemplated herein, executed includes a change in pressure from one pressure value to another pressure value within a CVAC device as also described herein. The methodologies described herein provide superior benefits compared to previously described static hypobaric pressure therapies in multiple ways, which can include reduced time frames of application and unique variations and combinations of atmospheric pressures. Furthermore, CVAC sessions can also provide beneficial effects via the vaso-pneumatic properties associated with the application of such sessions. In some embodiments, at least one of the starting point and the ending point in any CVAC Session is the ambient pressure at the delivery site. The targets inherent in any CVAC Session are connected or joined together by defined transitions. These transitions can include an increase in pressure (descent), a decrease in pressure (ascent), or a combination thereof. The nature of any transition may be characterized by the function of "delta P/T" (change in pressure over time). Transitions may be linear or produce a waveform. In some embodiments, all transitions produce a waveform. Suitable waveforms are sine, trapezoidal and square.

In some embodiments, additional targets which modulate time, temperature, and/or humidity run concurrently, sequentially, or at other intervals with the pressure targets when such additional targets and conditions are desired. In some embodiments, the entire collection of targets and/or transitions are delivered in a twenty minute CVAC Session, although the time of each session may vary in accordance with the desired outcome of the administration of the CVAC Session(s). For example, CVAC sessions may be administered over minute increments such as 5, 10, 15, 16, 17, 18, 19, 20, 25, 30 minutes or more. The length of each CVAC Session is customizable for each user.

A Set-Up Session: The Set-Up Session may also be considered a Program. It is a single session designed to prepare a new user for the more aggressive maneuvers or transitions encountered in the subsequent Sessions that the user will undergo. The Set-Up session accounts for all ages and sizes and conditions, and assumes a minimal gradient per step exercise that allows the ear structures to be more pliant and to allow for more comfortable equalization of pressure in the ear structures. The purpose of the Set-Up session is to prepare a new user for their custom Program based upon the group into which they have been placed.

The function of the Set-Up session is to qualify a user as being capable of adapting to multiple pressure changes in a given Session with acceptable or no discomfort. Set-Up session transitions may be linear or produce a waveform. In some embodiments, all transitions during a Set-Up session are linear. This is accomplished by instituting a gradient scale increase in pressure targets from very slight to larger increments with slow transitions increasing until a maximum transition from the widest difference in pressure targets is accomplished with no discomfort. The structure of a Set-Up session according to an embodiment is as follows: as with any Session, the starting point and ending point can both be ambient pressure. A target equivalent to about 1000 ft above ambient pressure is accomplished via a smooth linear transit. A second target equivalent to about 500 ft less than the first target is accomplished via a slow to moderate transit. These two steps are repeated until the user returns a "continue" or "pass" reply via an on-board interface. When the user has indicated that they are prepared to continue, the initial target (1000 ft above ambient) is increased by a factor of 500 ft, making it about 1500 ft. The secondary target (500 ft less than the first target) remains the same throughout the session until the exit stage is reached. In this example, each time the user indicates that they are ready to increase their gradient, the target is increased by a factor of about 500 ft. At this time, the transits remain the same but the option of increasing gradient (shorter time factor) in the transits is available. In some embodiments, a user can optionally resume a lower gradient, if desired. There can be an appropriate icon or pad that allows for this option on the on-board interface display screen.

In some embodiments, the Set-Up Session lasts no longer than 20 minutes. A Set-Up session typically runs for twenty minutes maximum and executes a final descent to ambient atmospheric pressure upon beginning the last transit. The Set-Up session is a new user's Program until the user is able to fully complete the Set-Up session (that is to continue the targets and transits to the highest gradient) with no interrupts or aborts. When administering CVAC sessions for medical treatment, Set-Up sessions may be customized to suit the requirements of their medical condition. The determination of the appropriate Set-Up Session can be made with guidance from or consultation with a user's qualified health professional, such as a treating physician.

The Interrupt: During any phase in a Session wherein a user desires to stop the Session at that point for a short time, they may do so by activating an icon or other appropriate device on the on-board interface touch screen or control pad or notifying the operator of the device. This will hold the Session at the stage of interruption for a predetermined time period, such as a minute, at which time the Session will continue automatically. In some embodiments, a Session may be interrupted three times after which a staged descent will occur and the user will be required to exit the pressure vessel. The user's file may be flagged and the user may be placed back on the Set-Up Sessions until it is satisfactorily completed. A warning or reminder may be displayed on the screen each time an interrupt is used that informs the user of how many times interrupt has been used and the consequences of further use.

During any session, be it a Set-Up session or other type of session, a staged descent is also available if the user develops ear or sinus discomfort or wishes to terminate the session for any reason. A staged descent is characterized by slow, 1000 ft sine wave descent transits with re-ascensions of 500 ft at each step. The descents can be of greater or lesser transits but the ratio is usually about 1.5:1. At any time during the staged descent, the user can interrupt the descent and hold a given level or resume a previous level until comfort is achieved. The user may also re-ascend at their option if the staged descent is too aggressive. Any re-ascension is done in stages as described above. The user can subsequently indicate a "continue" on the descent and the staging will resume. This stepping continues until ambient pressure is reached whereupon the canopy or entrance to the device opens such that the user can exit the pressure vessel.

The Abort: When a user wishes to end a session immediately and quickly exit the pressure vessel, the abort function can be activated. Touching the "abort" icon on the on-board interface touch pad/screen or notifying the operator of the device enables this option. A secondary prompt is activated acknowledging the command and asking the user if they are sure they want to abort. The user indicates their commitment to the command by pressing "continue" or "yes". The program is aborted and a linear moderate descent is accomplished to ambient pressure whereupon the canopy or entrance to the device opens and the user exits. The user's file is flagged. The next time the user comes in for their session, the user is asked whether the abort was caused by discomfort. If yes, the user is placed back on the Set-Up session program. If no, the user is asked if they wish to resume their regularly scheduled session. The client is given the option of resuming their regularly scheduled Session or returning to the Set-Up session.

Program and Target Criteria, Including Medically Significant Criteria: In some embodiments, a user is categorized into a group of users having similar body-types with similar characteristics based upon answers to a questionnaire or information otherwise obtained from the user. The information from the user guides the construction of custom CVAC programs for each individual. When administering CVAC programs for treatment of chronic pain, the medical status of the user can also be used to determine appropriate pressures and additional parameters (such as duration, temperature, or humidity) of the targets. Custom session targets may be administered based upon the medical condition and therapy desired. The acceptable and appropriate target parameters may be obtained as described herein and through consultation with the user's physician or other appropriate health-care provider prior to designing session targets and administering a CVAC session. However the known contraindications of CVAC are similar to those of commercial air travel, allowing for a broad range of application.

Methods of Treatment:

In one aspect, CVAC sessions for the treatment of chronic pain are administered for at least 10 minutes, and in some embodiments for at least 20 minutes, with variable frequency. Additional administration periods may include, but are not limited to, about 10 minutes, about 20 minutes, about 30 minutes, about 40 minutes, about 60 minutes, between 10 and 20 minutes, between 20 and 30 minutes, between 30 and 60 minutes, and between 60 and 120 minutes.

Frequencies of sessions or series of sessions may include, but are not limited to, daily, monthly, or when medically indicated or prescribed. The frequency and duration of the sessions can be altered to suit the medical condition to be treated, and CVAC sessions may be administered as single sessions, or as a series of sessions, preferably with a Set-Up Session as described herein. For example, the frequency of sessions or series of sessions can be administered 3 times a week for 8 weeks, 4 times a week for 8 weeks, 5 times a week for 8 weeks, or 6 times a week for 8 weeks. Additional frequencies can be easily created for each individual user.

Similarly, the targets in the sessions can also be altered or adjusted to suit the individual and medical condition to be treated. If at any time the user or attendant determines that the session is not being tolerated well, an abort may be initiated and the user brought down safely and exited. The permutations of targets can be customized to the individual, and may again be identified with the help of any person skilled in the art, such as a treating physician. Furthermore, the variations may be administered in regular intervals and sequence, as described, or in random intervals and sequence. The variations in number, frequency, and duration of targets and sessions can be applied to all methods of treatment with CVAC described herein. Treat or treatment, as used herein refers to the treatment of a disease or disorder related to abnormal levels of lipids. This includes, but is not limited to, inhibiting the disease or disorder, arresting the development of the disease or disorder, relieving the disease or disorder, or stopping the symptoms of the disease or disorder. Thus, as used herein, the term "treatment" is used synonymously with the terms "alleviation," "amelioration," "prophylaxis," or "prevention." Treatment can refer to a reduction in lipid levels compared to no treatment (e.g. about 1% less, about 2% less, about 3% less, about 4% less, about 5% less, about 10% less, about 20% less, about 50% less, about 100% less, and any range therein). Treat or treatment, as used herein, can also refer to the treatment of a disease or disorder, and more specifically to the treatment of loss of sensation or chronic pain. Treatment can refer to a reduction in perceived chronic pain levels compared to no treatment (e.g. about 1% less, about 2% less, about 3% less, about 4% less, about 5% less, about 10% less, about 20% less, about 50% less, about 100% less, and any range therein).

In an embodiment of the present invention, Cyclic Variations in Altitude Conditioning Program (CVAC) is used to treat users who wish to modulate their serum lipid levels. CVAC is administered to stimulate the reduction in serum lipid levels in a user as well as stimulate other associated physiological processes affected by CVAC treatment such as fluid movement, vas-pneumatic pressure on the user, and the cellular processes initiated by hypoxic exposure. Treatment is administered through the use of one or more CVAC sessions. Such sessions may be user defined or custom-defined with input from the user's physician. In an embodiment of the present invention, Cyclic Variations in Altitude Conditioning Program (CVAC) is used to treat users who wish to lower their serum lipid levels. In another embodiment of the present invention, CVAC is used to modulate LDL. In another embodiment of the present invention, CVAC is used to modulate cholesterol. In another embodiment of the present invention, CVAC is used to modulate VLDL (very low-density lipoprotein). In yet another embodiment of the present invention, CVAC is used to modulate HDL. In further embodiments, two or more of, in any combination of, cholesterol, VLDL, LDL, and HDL can be modulated by the same application of at least one CVAC session.

In another aspect of the present invention, CVAC sessions are administered for the modulation of steroidogenesis. As described herein, modulation of steroidogenesis includes, but is not limited to, increases and decreases in steroid levels in the user. Steroidogenesis includes, but is not limited to, the production of steroids. Steroid as used herein includes, but is not limited to, all hormones and steroid compounds produced from cholesterol. Examples of groups of such compounds include androgens, estrogens, progestogens, mineralocorticoids, and gluococorticoids. Further examples of hormones include testosterone and estrogens. Still further examples of estrogens include estradiols, estriols, and estrones. Similarly, the treatment of steroidogenesis includes administration for modulation of steroid levels and steroidogenesis. CVAC sessions for the treatment of steroidogenesis are administered preferably for at least 10 minutes, and more preferably at least 20 minutes, with variable frequency. Additional administration periods may include, but are not limited to, about 10 minutes, about 20 minutes, about 30 minutes, about 40 minutes, about 60 minutes, between 10 and 20 minutes, between 20 and 30 minutes, between 30 and 60 minutes, and between 60 and 120 minutes. Frequencies of sessions or series of sessions may include, but are not limited to, daily, monthly, or when medically indicated or prescribed. The frequency and duration of the sessions can be altered to suit the medical condition to be treated, and CVAC sessions may be administered as single sessions, or as a series of sessions, preferably with a Set-Up Session as described herein. For example, the frequency of sessions or series of sessions can be administered 3 times a week for 8 weeks, 4 times a week for 8 weeks, 5 times a week for 8 weeks, or 6 times a week for 8 weeks. Additional frequencies can be easily created for each individual user. Similarly, the targets in the sessions can also be altered or adjusted to suit the individual and medical condition to be treated. If at any time the user or attendant determines that the session is not being tolerated well, an abort may be initiated and the user brought down safely and exited.

The permutations of targets can be customized to the individual, and may again be identified with the help of any person skilled in the art, such as a treating physician. Furthermore, the variations may be administered in regular intervals and sequence, as described, or in random intervals and sequence. The variations in number, frequency, and duration of targets and sessions can be applied to all methods of treatment with CVAC described herein. As used herein, "modulation" includes increases or decreases in steroidogenesis as well as increases or decreases in serum and/or tissue steroid levels. Modulation can refer to increases in serum or tissue steroid levels compared to no treatment (e.g. about 1% more, about 2% more, about 3% more, about 4% more, about 5% more, about 10% more, about 20% more, about 50% more, about 100% more, and any range therein).

In an embodiment of the present invention, CVAC is administered to increase the levels of testosterone in the user. In a further embodiment, CVAC is administered to modulate levels of steroids in an HIV-infected or HIV-positive individual. In one non-limiting example, at least one CVAC session is administered to and HIV-infected individual to increase the levels of testosterone in the HIV-infected individual. In an additional embodiment, CVAC is administered to a user to increase the levels of estrogen in an HIV-infected user. In an additional embodiment, CVAC is administered to a user to decrease the levels of testosterone or estrogen in the user. In yet another embodiment, CVAC is administered to a user to modulate the levels of glucocorticoids, mineralocorticoids, or androgens. In still further embodiments, CVAC is administered to modulate steroid levels and cholesterol levels in an HIV-infected user. In still further embodiments, CVAC is administered to modulate both steroid levels and serum lipid levels in an HIV-infected user. In further embodiments, at least one CVAC session is administered to increase steroid levels in an HIV-infected subject for the treatment of weight loss, wasting syndrome, or loss of muscle mass. Treatment is administered through the use of one or more CVAC sessions. Such sessions may be user defined or custom-defined with input from the user's physician.

In yet another embodiment, at least one CVAC session is administered to a user to modulate steroid levels in a subject for the treatment, prevention or amelioration of metabolic syndrome. In additional embodiment, at least one CVAC session is administered to modulate steroid levels in an individual for the treatment prevention or amelioration of type-2 diabetes. In yet another embodiment, at least one CVAC session is administered to modulate steroid levels in an individual for the treatment, prevention or amelioration of insulin resistance. In a further embodiment, at least one CVAC session is administered to increase steroid levels in a subject for the treatment of metabolic syndrome. In another embodiment, at least one CVAC session is administered to increase steroid levels in a subject for the treatment of type-2 diabetes. In yet another embodiment, at least one CVAC session is administered to increase steroid levels in a subject for the treatment of insulin resistance. In one non-limiting example, at least one CVAC session is administered to increase testosterone in a subject for the treatment of metabolic syndrome. In another non-limiting example, at least one CVAC session is administered to increase testosterone in a subject for the treatment of type-2 diabetes. In additional embodiments, CVAC sessions are administered to increase steroid levels for the prevention of metabolic syndrome or insulin resistance.

CVAC sessions for any of the aforementioned aspects and embodiments may also be used in combination with pharmaceutical regimens or non-pharmaceutical therapies such as physical therapy or homeopathic therapies. As described above, CVAC sessions of any combination or permutation can be administered prior to, concurrent with, or subsequent to administration of a pharmaceutical, pharmaceuticals, or non-pharmaceutical therapy. Myriad permutations of pharmaceutical therapies, non-pharmaceutical therapies, and CVAC session combinations are possible, and combinations appropriate for the type of medical condition and specific pharmaceutical may be identified with the help of any person skilled in the art, such as a treating physician.

Figure 1B:
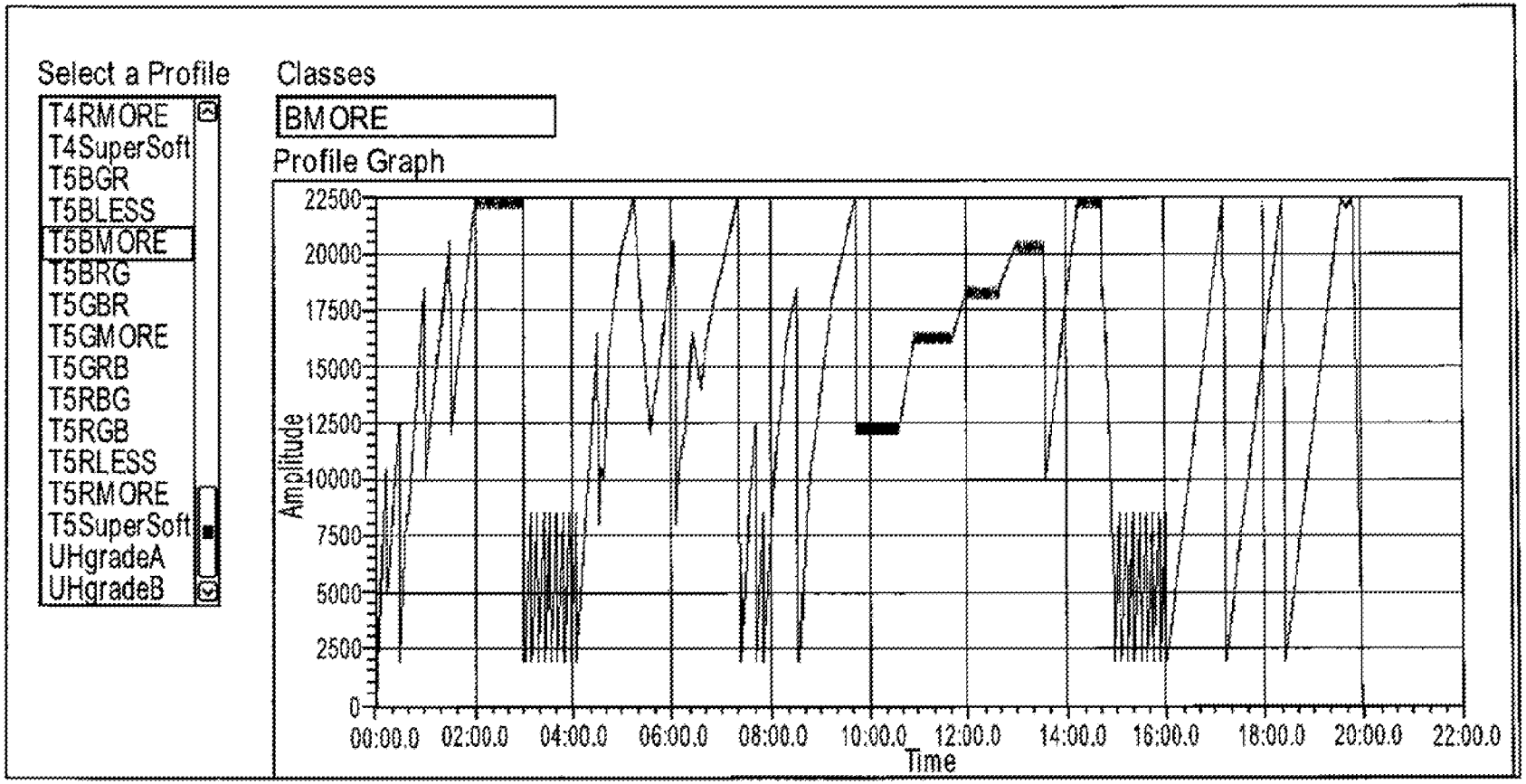
FIG. 1B is a graphical illustration of various pressures applied over time for a selected CVAC session profile according to an embodiment. The Y-axis again represents atmospheric pressure levels and the X-axis represents time. Different pressures were again applied, as indicated by changes in value on the Y-axis, for various lengths of time, as indicated by the changes in values on the X-axis. This exemplary CVAC session was 20 minutes in length.

Specific examples of a CVAC session are shown graphically in FIGS. 1A and 1B. In both figures, the parameters of the program are shown as a line graph with axes that correspond to time (x-axis) and pressure change (y-axis). The pressure change is shown in amplitudes, and corresponds to a pressure at a number of feet above atmospheric pressure (represented by the number zero).

Efficacy of Treatment

Assessment of CVAC efficacy in the aforementioned aspects and embodiments can be investigated through various physiological parameters. Changes in serum lipid levels can be assessed by evaluation of cholesterol, VLDL, LDL, and HDL levels in a user. By example only, when levels of LDL are the physiological parameter examined, decreases in the levels of LDL in a user's blood or serum are indicative of efficacious CVAC treatments. Similarly, when the physiological parameter is cholesterol, reductions in cholesterol levels are indicative of efficacious CVAC treatment. Serum steroid and hormone levels can be assayed via RIA, ELISA, immunometric assays, equilibrium dialysis, or liquid chromatography tandem mass spectrometry. Additional steroid and hormone assays are known in the art and contemplated herein. In one example, serum total testosterone is determined by RIA, with free testosterone determined by equilibrium dialysis. Additionally, weight gain, increases in lean-body mass, and/or increases in muscle strength indicate efficacy of CVAC for increasing steroid levels in an HIV-infected subject.

Further methods of assessing CVAC efficacy for changes in serum lipid levels include non-invasive imaging techniques such as MRI as well as invasive imaging techniques such as catheterization and endoscopy. Additional imaging techniques will be well known in the art and easily applied to the present invention.

When treating or modulating steroidogenesis and/or steroid levels, a user's steroid or hormone levels may be assessed for determination of CVAC efficacy. For but one example only, when testosterone is the physiological parameter assessed, increases in testosterone levels can be indicative of efficacious CVAC treatment. Similarly, increases in estrogen levels can be indicative of efficacious CVAC treatment. In further embodiments, modulation of a user's androgen levels, progestogen levels, mineralocorticoid levels, or glucocorticoid levels are indicative of efficacious CVAC treatment. In still further embodiments, decreases in a user's androgen levels, progestogen levels, mineralocorticoid levels, or glucocorticoid levels are indicative of efficacious CVAC treatment.

Additionally, increases in a subjects weight, muscle mass, or lean-body mass are indicative of efficacious CVAC treatment for increasing steroid levels in an HIV-infected subject. Similarly, increases in muscle strength can also be are indicative of efficacious CVAC treatment for increasing steroid levels in an HIV-infected subject. Established methods of monitoring and assessing weight gain, muscle mass, lean-body mass, and muscle strength are known in the art and contemplated herein.

Efficacy of CVAC treatments for modulation of steroid levels for the treatment of metabolic syndrome, type-2 diabetes, or insulin resistance can be evaluated by assessment of insulin regulation, glucose tolerance, and glucose transport. Assays for such criteria are well know in the art and can be evaluated with a variety of imaging and assessment techniques. By example only, increase of insulin levels is indicative of efficacious CVAC treatments for modulation of steroid levels to treat metabolic syndrome type-2 diabetes, or insulin resistance. Similarly, a decrease of glucose levels is indicative of efficacious CVAC treatment for the modulation of steroid levels to treat metabolic syndrome, type-2 diabetes, or insulin resistance, and modulation of glucose transport is indicative of CVAC efficacy for the modulation of steroid levels to treat metabolic syndrome, type-2 diabetes, or insulin resistance. Conversely, a lack of change in the user's insulin (or with any of the physiological markers described herein) does not necessarily indicate that the CVAC treatments are not achieving positive results. Efficacy of CVAC sessions for the modulation of steroid levels to treat metabolic syndrome, type-2 diabetes, or insulin resistance can also be determined by assessment of testosterone levels in a user, as described above.

Additional criteria for assessing the efficacy of the aforementioned aspects and embodiments will be known by those of skill in the art and can be employed to assess the beneficial effects of CVAC programs.

Methods for treating serum lipid levels and treating steroidogenesis by administration of various environmental pressure levels for hypoxic conditioning are disclosed herein. Previously described PVU and CVAC methodology is used to implement the methods for treatment of the aforementioned conditions, and alternative PVUs can be used with the disclosed methodologies.

EXAMPLES

Example 1

To assess the efficacy of CVAC sessions, 13 individuals, all between the ages of 20 and 40 years old, were administered CVAC sessions and changes in their erythropoietin (EPO) levels were measured. Frequency of CVAC administration was 3 CVAC sessions per day, 5 days per week, for seven weeks. All subjects were administered three different profiles, entitled BRO, RBO, and ORB. Each CVAC session profile cycled through a rotation of the pressures and parameters associated with that given profile. After completing three 20-minute CVAC sessions including a given profile, each subject then switched to a second CVAC session profile. The subjects then experienced three CVAC sessions of this second profile before switching to the third CVAC session profile. After completion of three CVAC sessions based on the third profile, the subject then returned to the first profile, with each profile be repeated in triad form. All CVAC sessions, regardless of the profile used, had a pressure ceiling corresponding to a specific tier. Subjects then progressed through five tiers, and each tiered level included a maximum pressure ceiling that corresponded to an altitude of 4000 feet higher than the previous tier. A subject was not allowed to switch to the next higher tier until the subject had experienced fifteen CVAC sessions at the lower tier. Sham sessions (or control sessions) correspond to the cycling of the five tier levels but do not contain any meaningful pressure changes (e.g. pressure changes equivalent to altitude of 2000 feet with very few changes in duration), thus the subjects experience the CVAC session for the equivalent 20 minute session, but without the pressure changes and durations. In this study, profiles BRG (FIGS. 4, 8, 12, and 16), RBG (FIGS. 5, 9, 13, and 17), GRB (FIGS. 6, 10, 14, and 18) (tiers 2-5 respectively) were administered in sequential order for tiers 2-5 as described above. Sham sessions corresponding to tiers 2, 3, 4, and five (FIGS. 7, 11, 15, and 19) were administered where indicated and the graphical representations corresponding to pressures are not indicative of the pressure changes in the CVAC unit. The simulated graphical output was for control purposes to keep the subjects blinded to the sham sessions.

Increases in EPO were measured prior to administration of CVAC and three hours post-administration of CVAC, and EPO concentration is expressed as mIU/ml. Thus changes in EPO can be represented by the formula: deltaEPO=Post-CVAC EPO mIU/ml−pre-CVAC EPO mIU/ml. The study found that EPO levels changed over the study period in the population. Specifically, mean changes in EPO concentration increased from 0.2 mIU/ml following the first 2 weeks of CVAC administration to 2.0 mIU/ml following 8 weeks of the CVAC administration. The changes in EPO levels found in the study population indicate that the administration of CVAC sessions can positively modulate EPO production, hence providing an alternative and efficacious method to exogenous EPO administration.

Example 2

Figure 4:
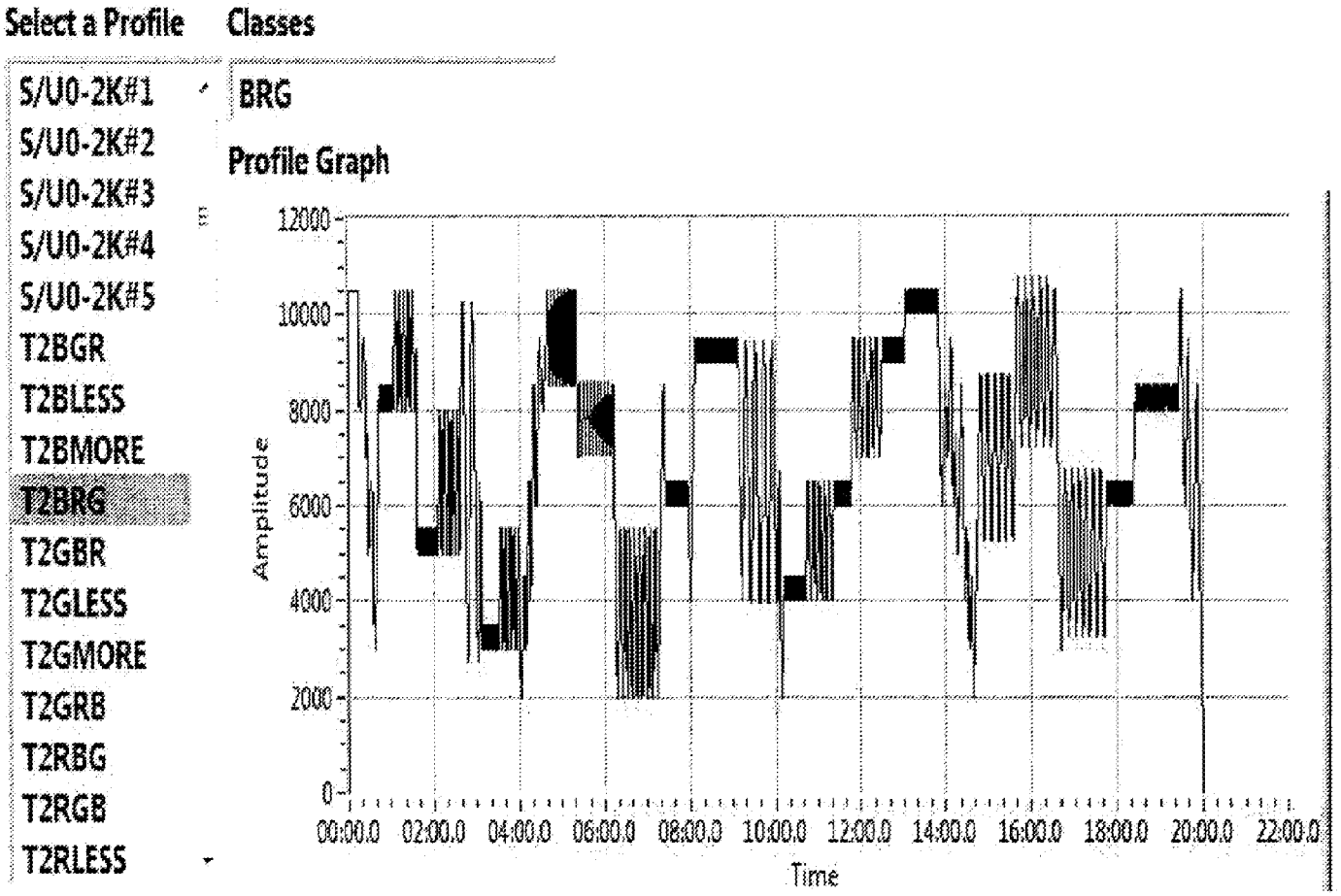
FIG. 4 is a graphical illustration of various pressures applied over time during a CVAC session using profile BRG at tier 2.
Figure 5:
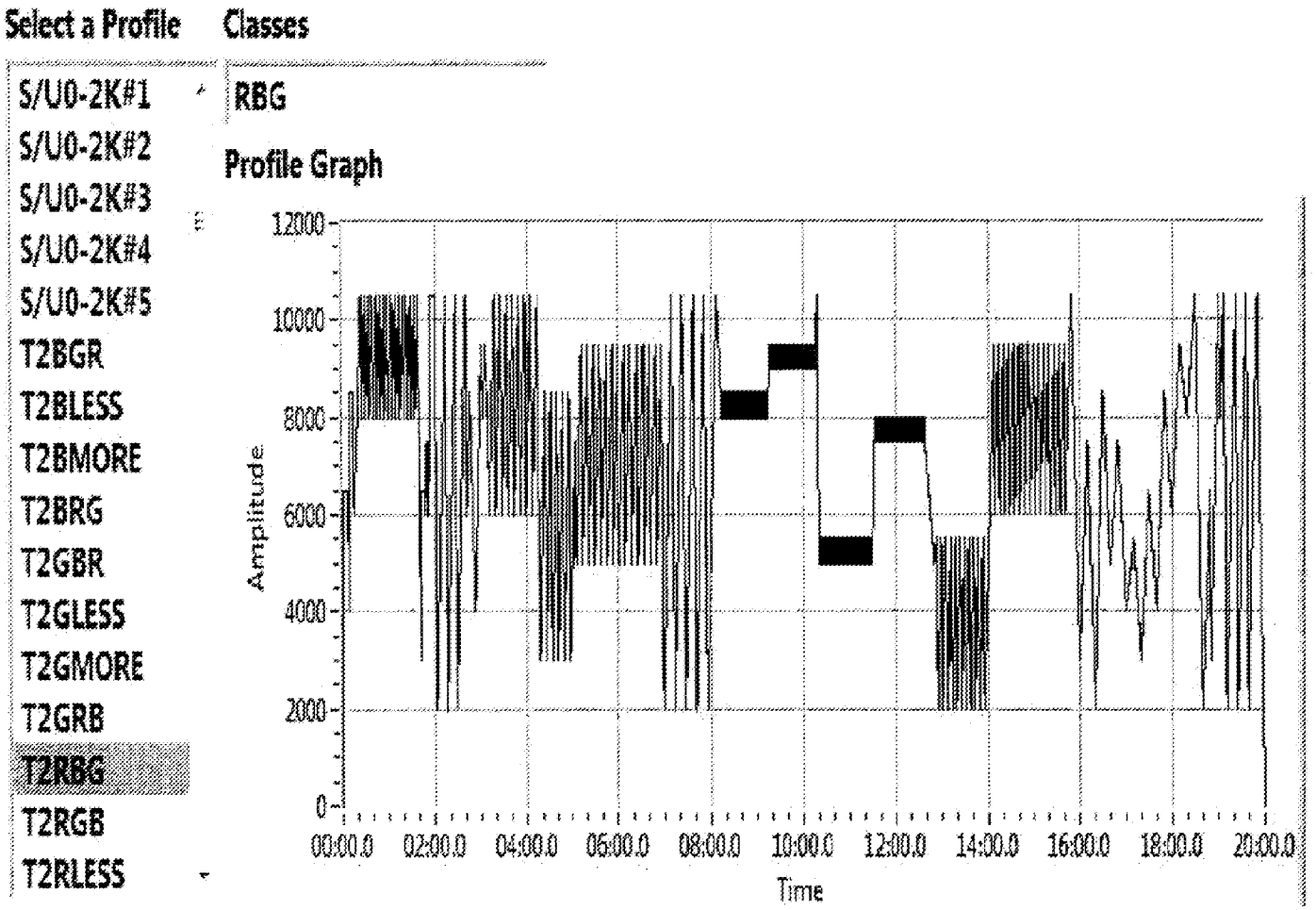
FIG. 5 is a graphical illustration of various pressures applied over time during a CVAC session using profile RBG at tier 2.
Figure 6:
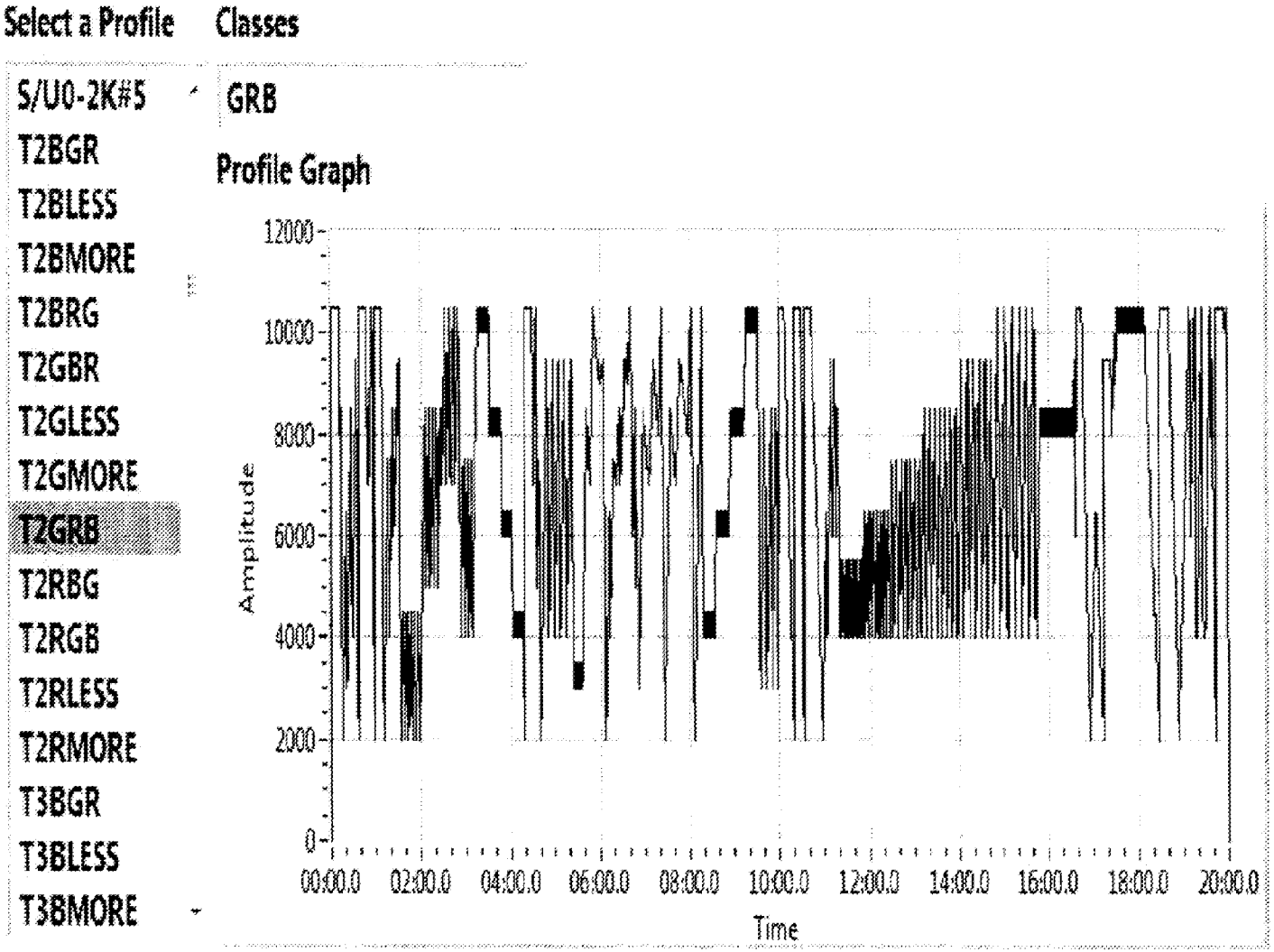
FIG. 6 is a graphical illustration of various pressures applied over time during a CVAC session using profile GRB at tier 2.
Figure 7:
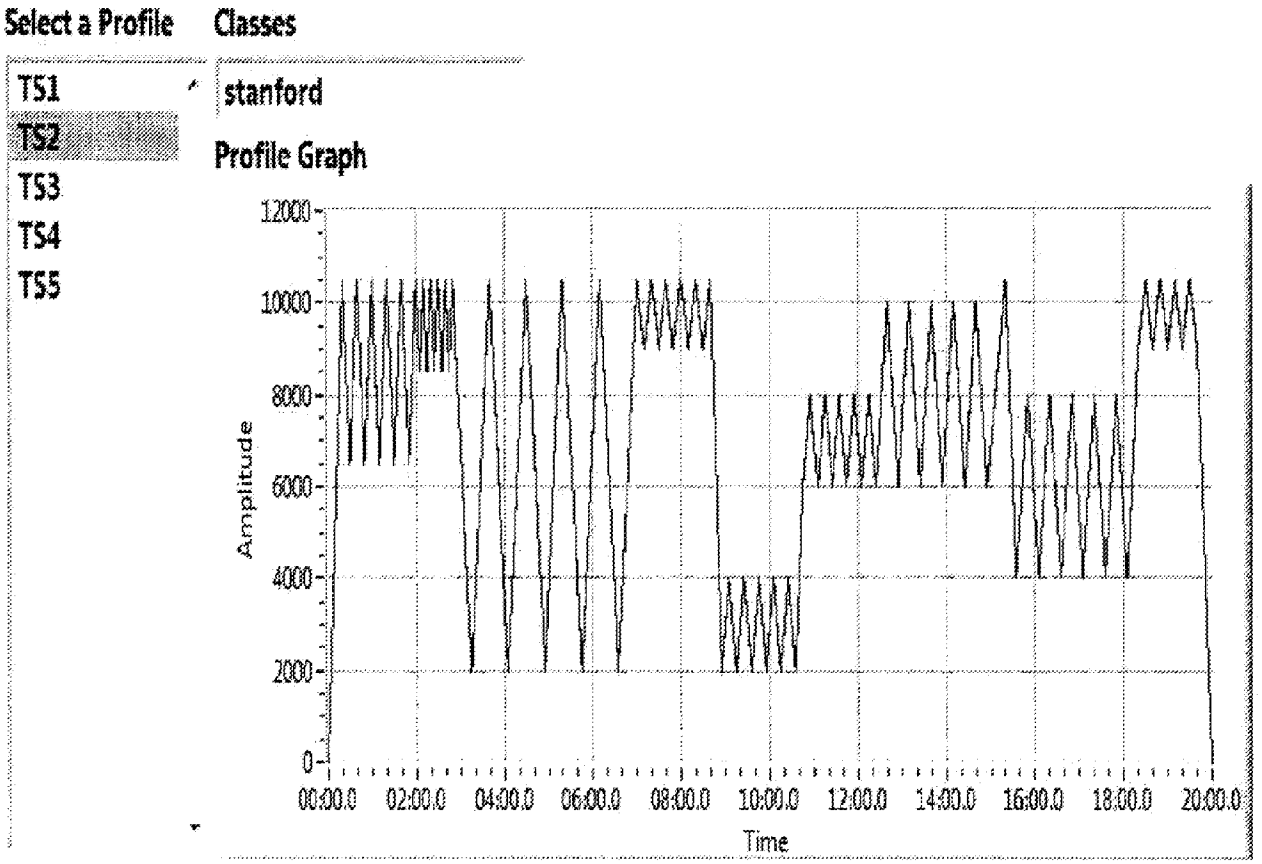
FIG. 7 is a graphical illustration of various pressures applied over time during a CVAC session using profile sham at tier 2.
Figure 8:
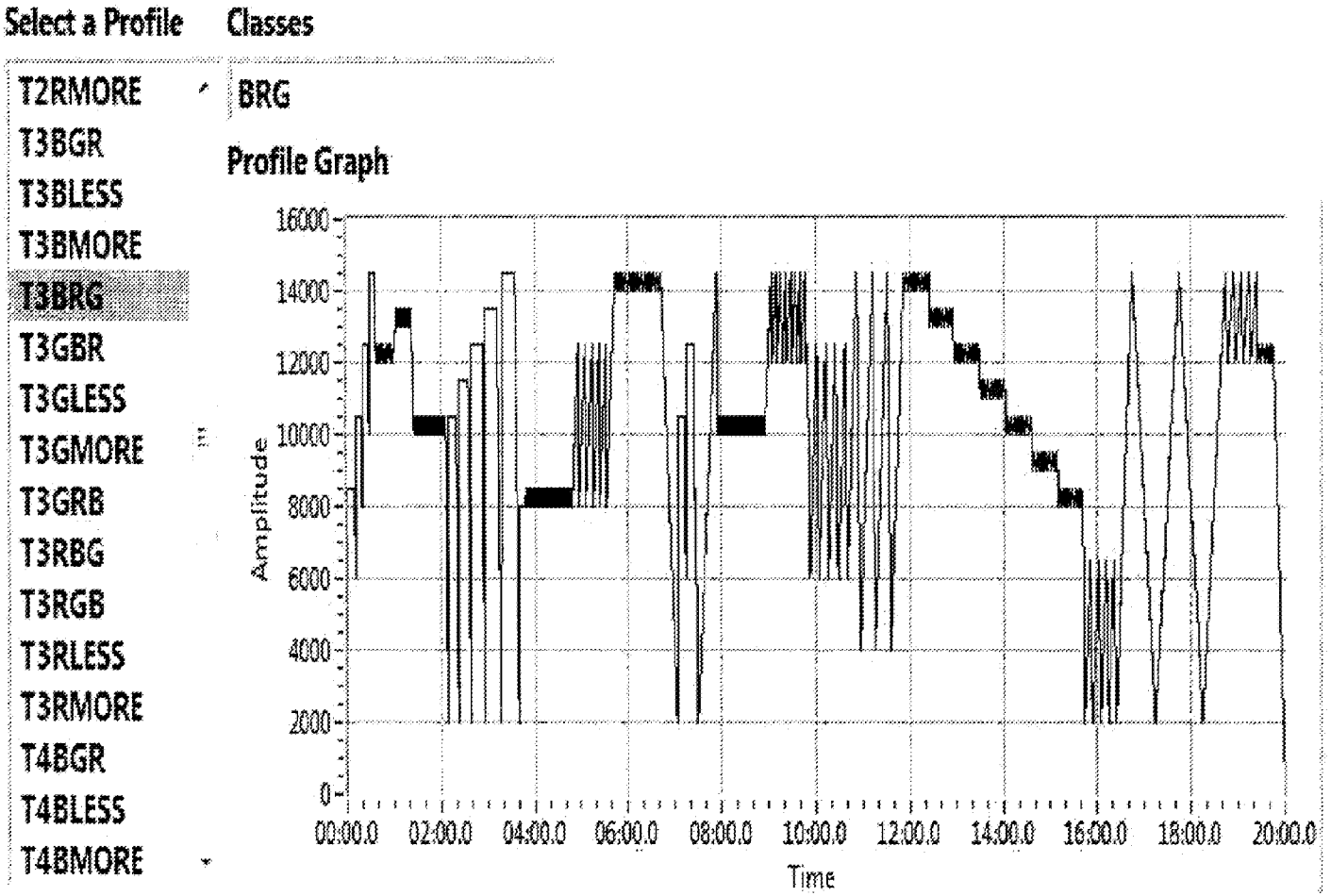
FIG. 8 is a graphical illustration of various pressures applied over time during a CVAC session using profile BRG at tier 3.
Figure 9:
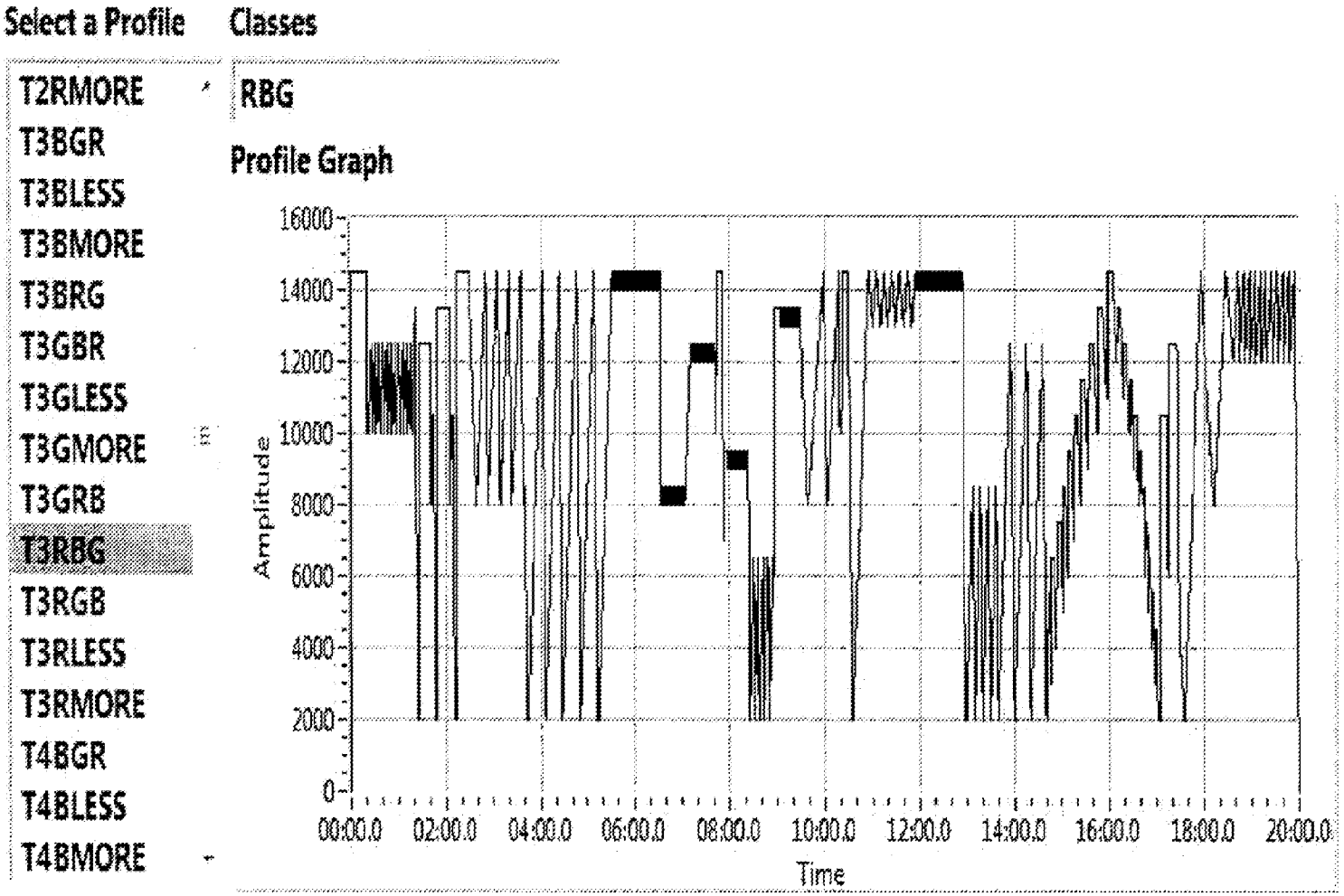
FIG. 9 is a graphical illustration of various pressures applied over time during a CVAC session using profile RBG at tier 3.
Figure 10:
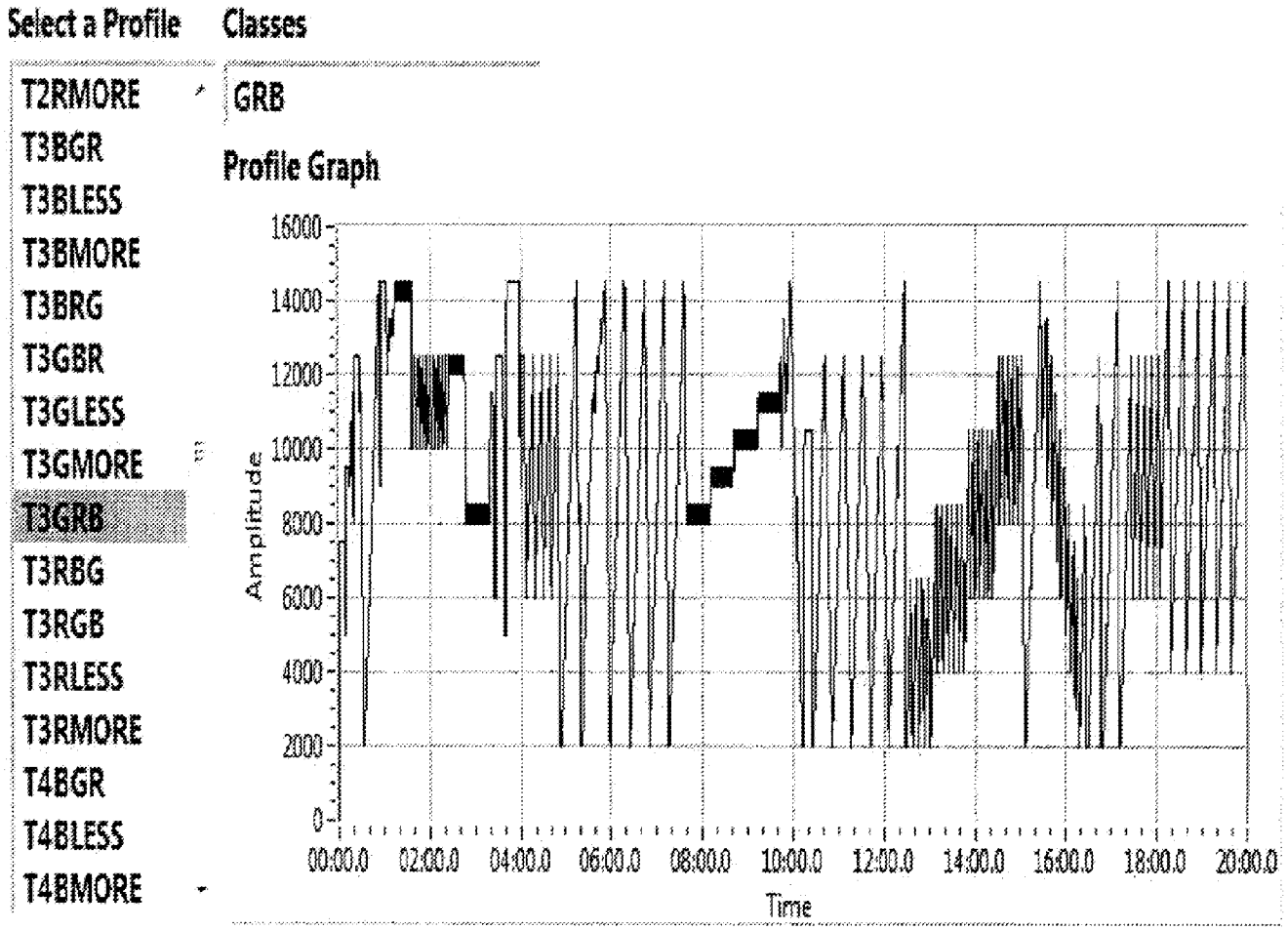
FIG. 10 is a graphical illustration of various pressures applied over time during a CVAC session using profile GRB at tier 3.
Figure 11:
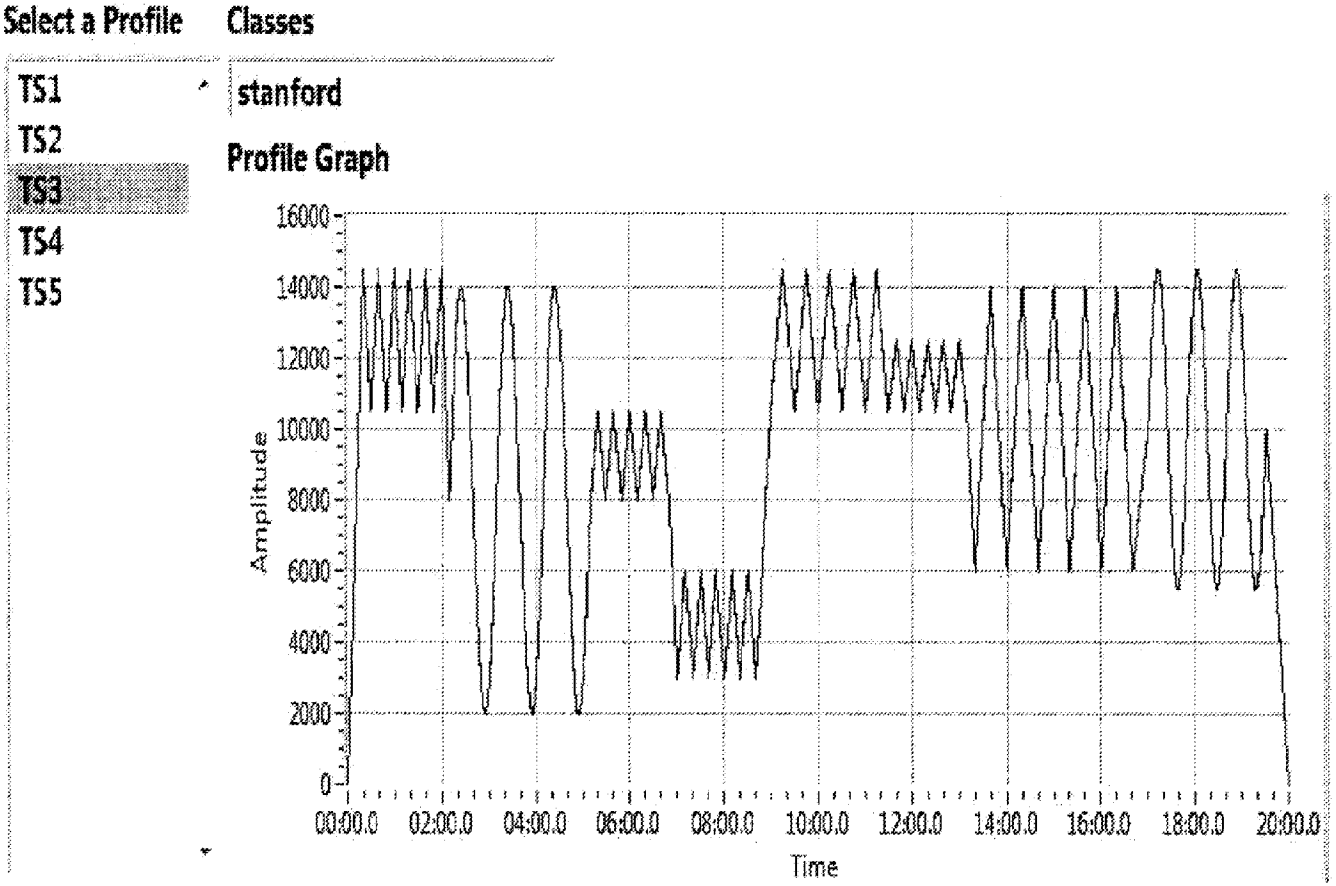
FIG. 11 is a graphical illustration of various pressures applied over time during a CVAC session using profile sham at tier 3.
Figure 12:
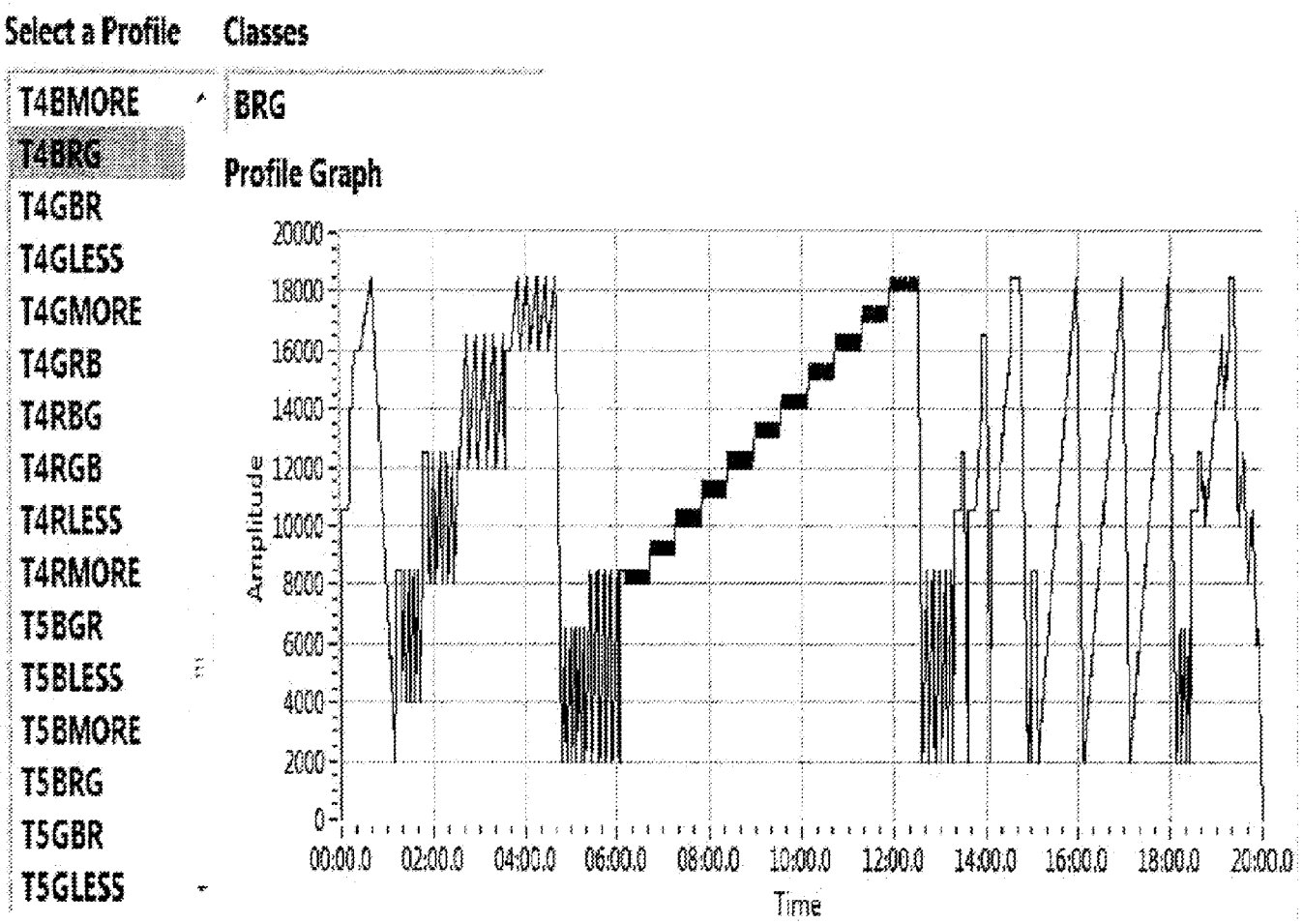
FIG. 12 is a graphical illustration of various pressures applied over time during a CVAC session using profile BRG at tier 4.
Figure 13:
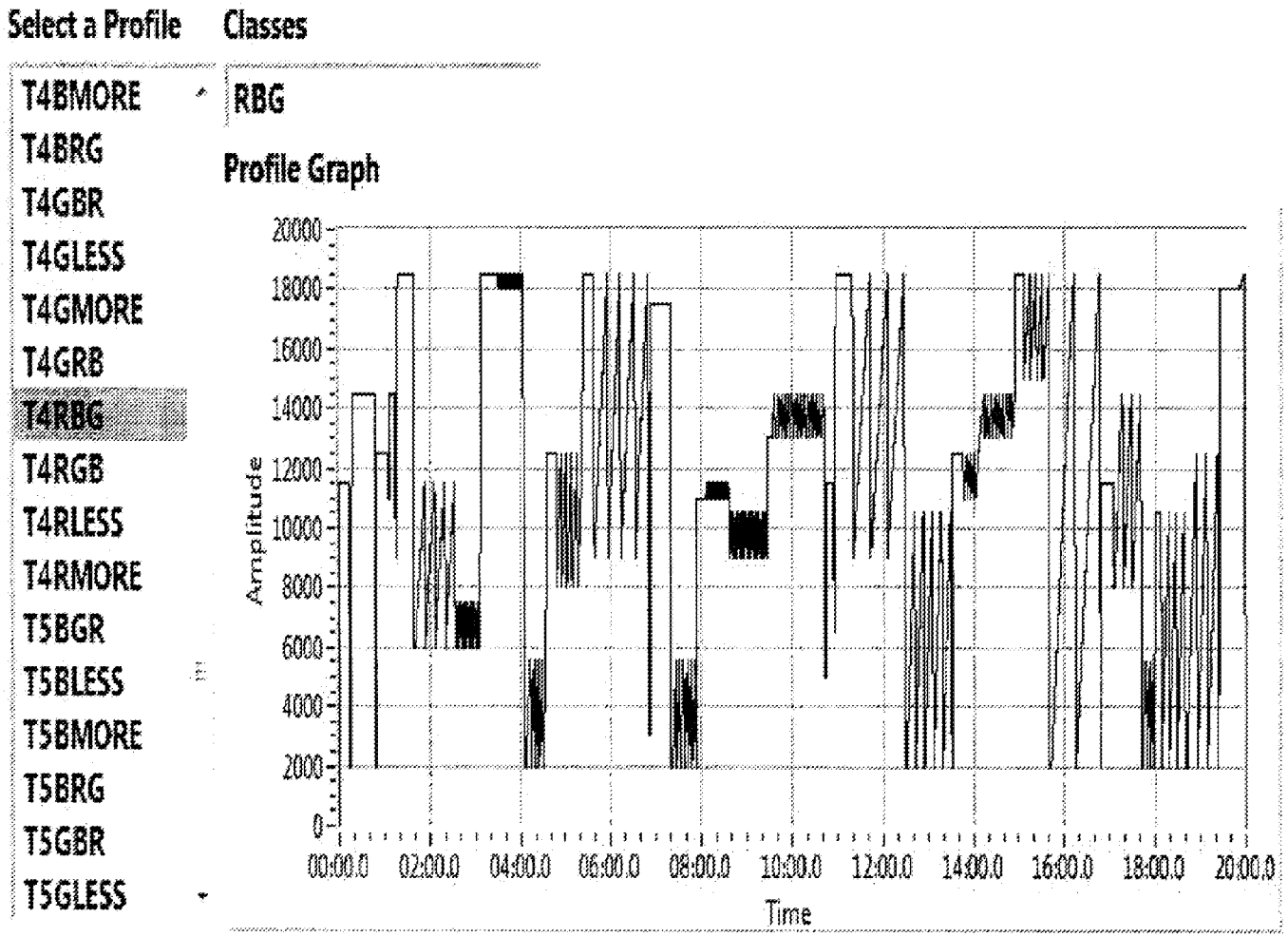
FIG. 13 is a graphical illustration of various pressures applied over time during a CVAC session using profile RBG at tier 4.
Figure 14:
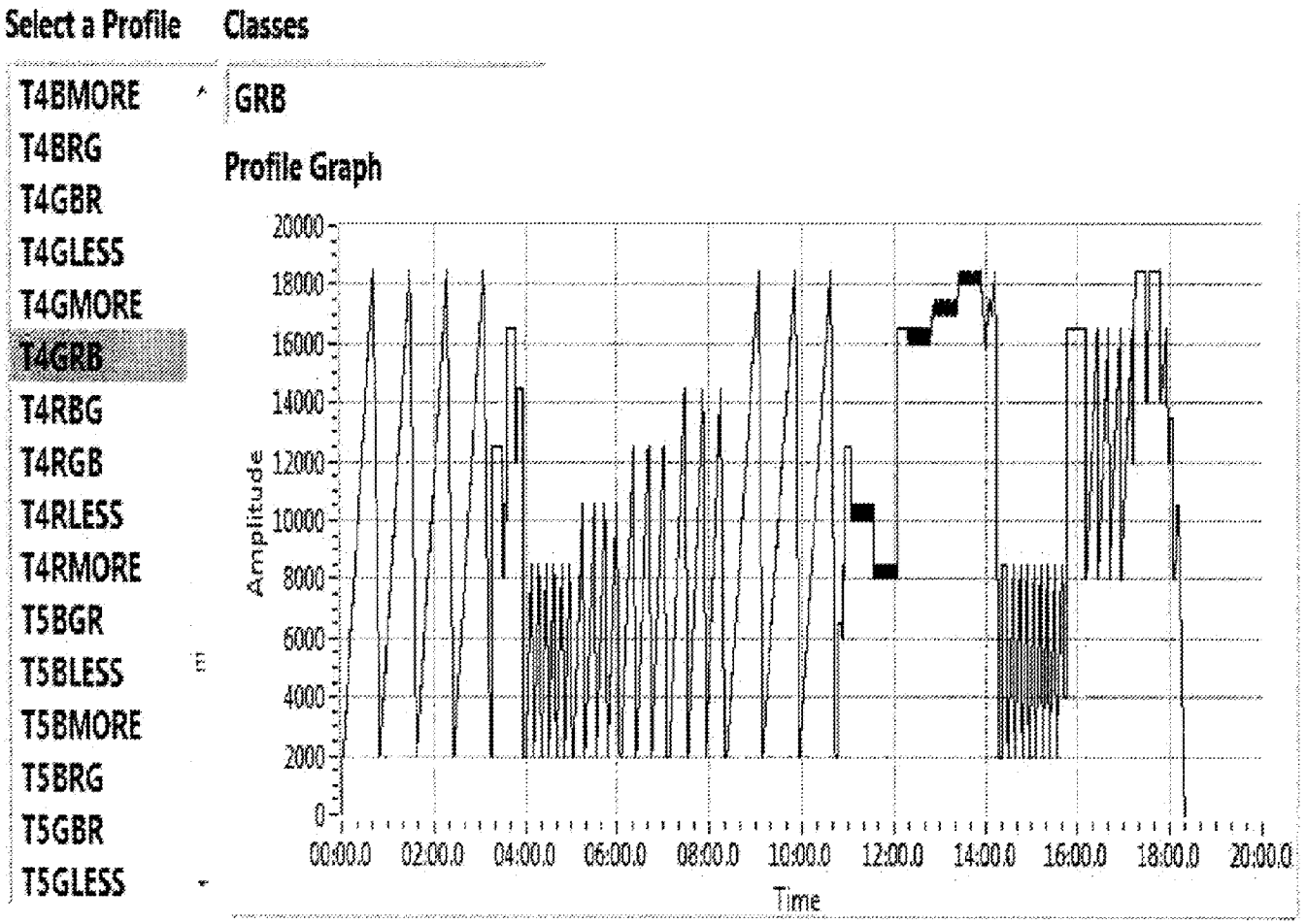
FIG. 14 is a graphical illustration of various pressures applied over time during a CVAC session using profile GRB at tier 4.
Figure 15:
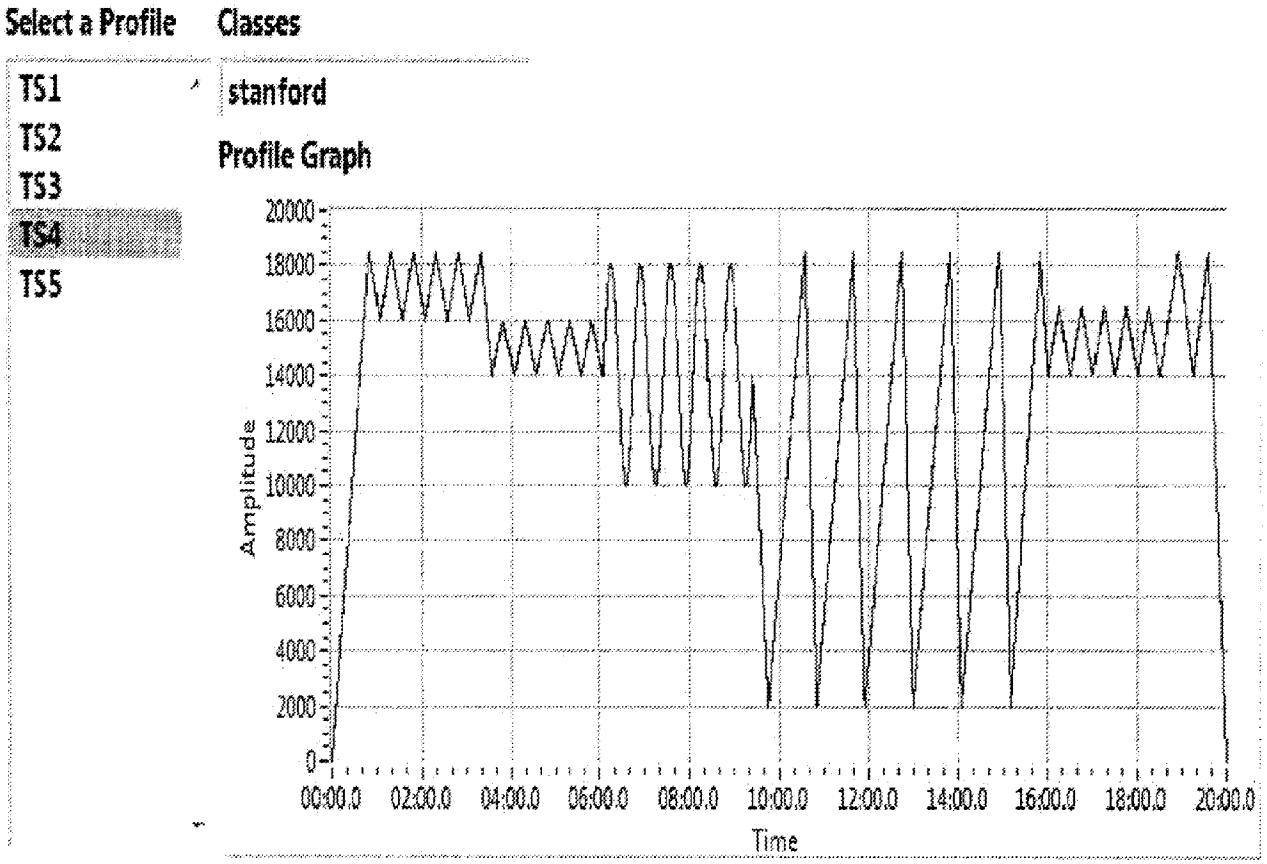
FIG. 15 is a graphical illustration of various pressures applied over time during a CVAC session using profile sham at tier 4.
Figure 16:
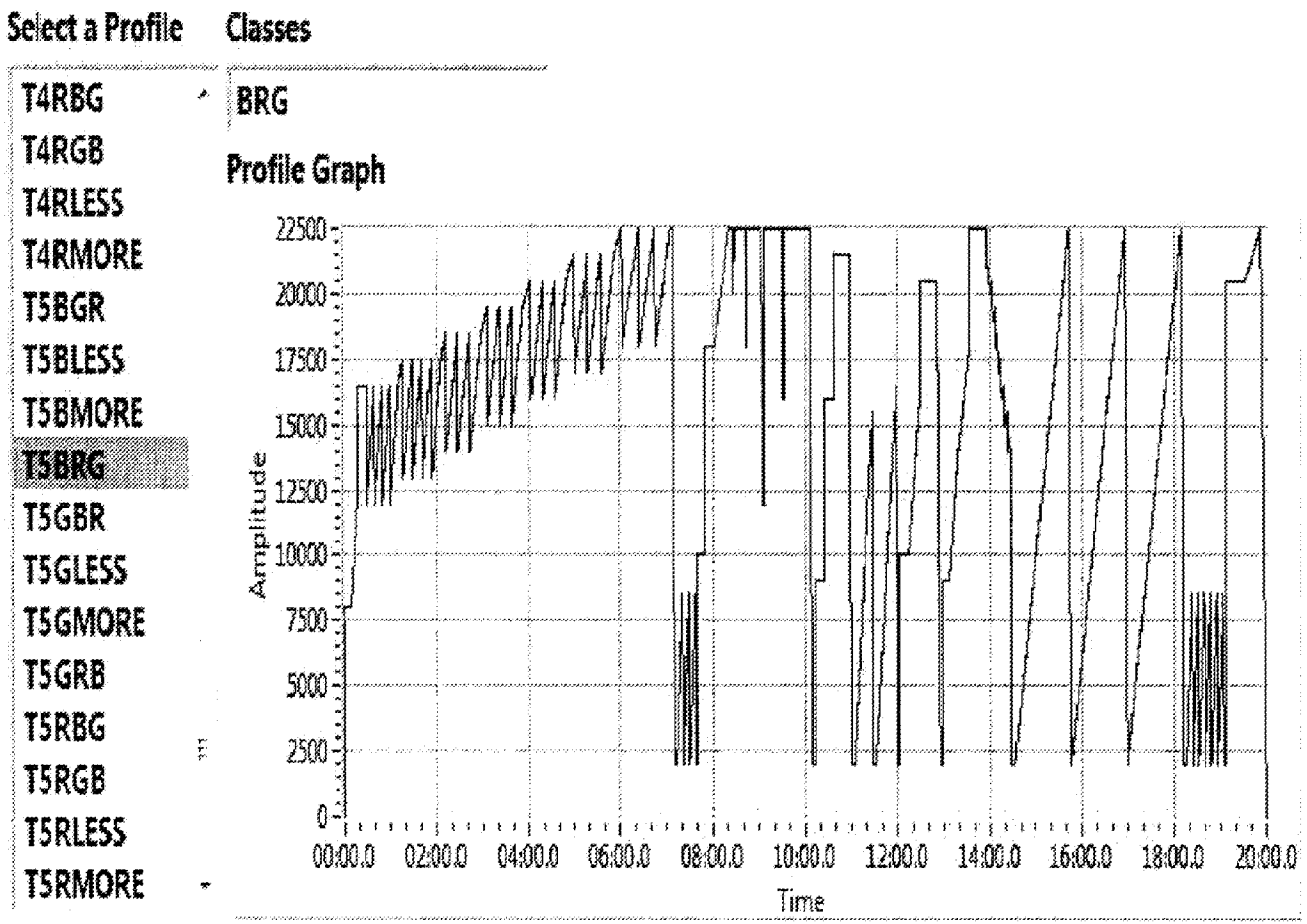
FIG. 16 is a graphical illustration of various pressures applied over time during a CVAC session using profile BRG at tier 5.
Figure 17:
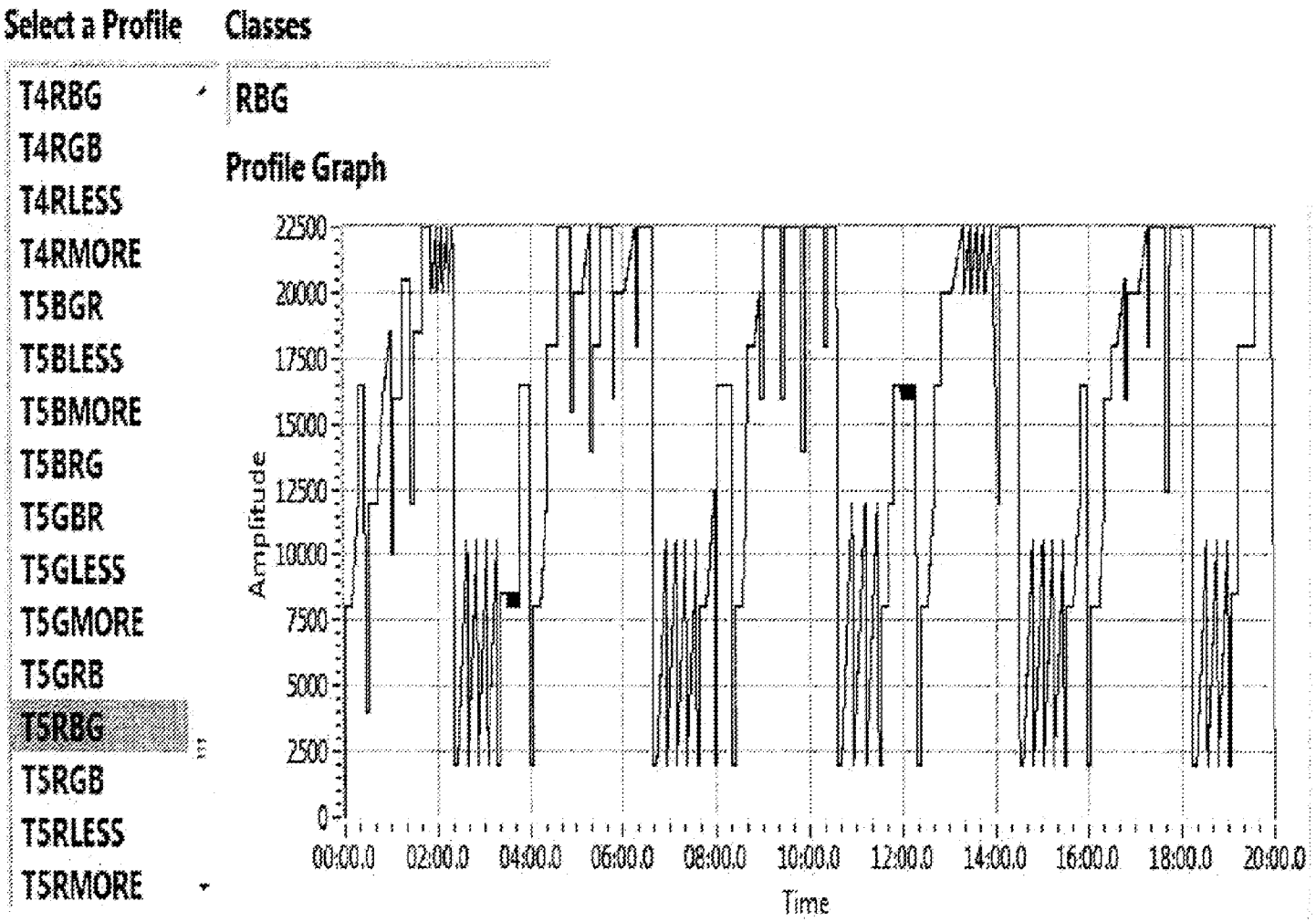
FIG. 17 is a graphical illustration of various pressures applied over time during a CVAC session using profile RBG at tier 5.
Figure 18:
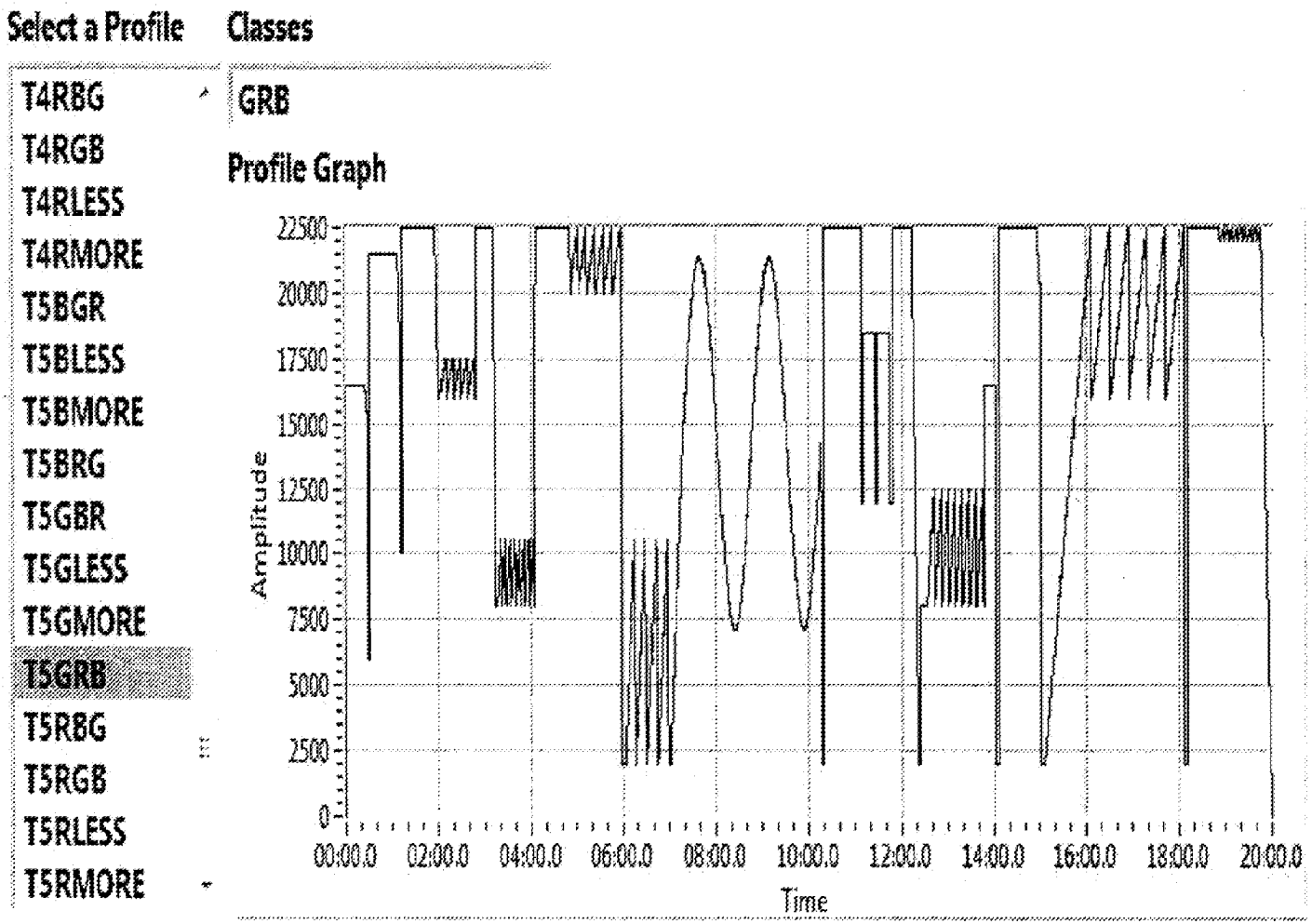
FIG. 18 is a graphical illustration of various pressures applied over time during a CVAC session using profile GRB at tier 5.
Figure 19:
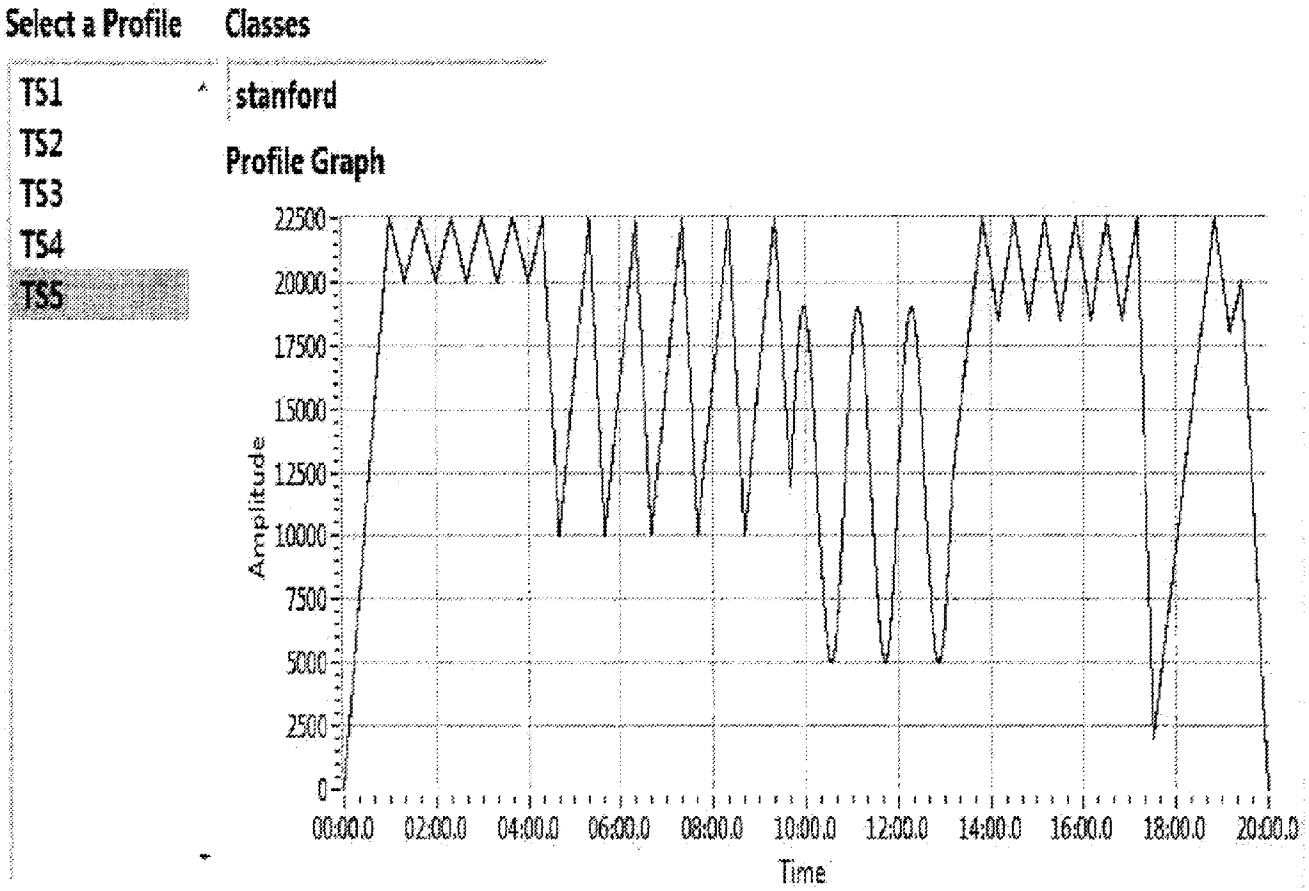
FIG. 19 is a graphical illustration of various pressures applied over time during a CVAC session using profile sham at tier 5.
Figure 20:
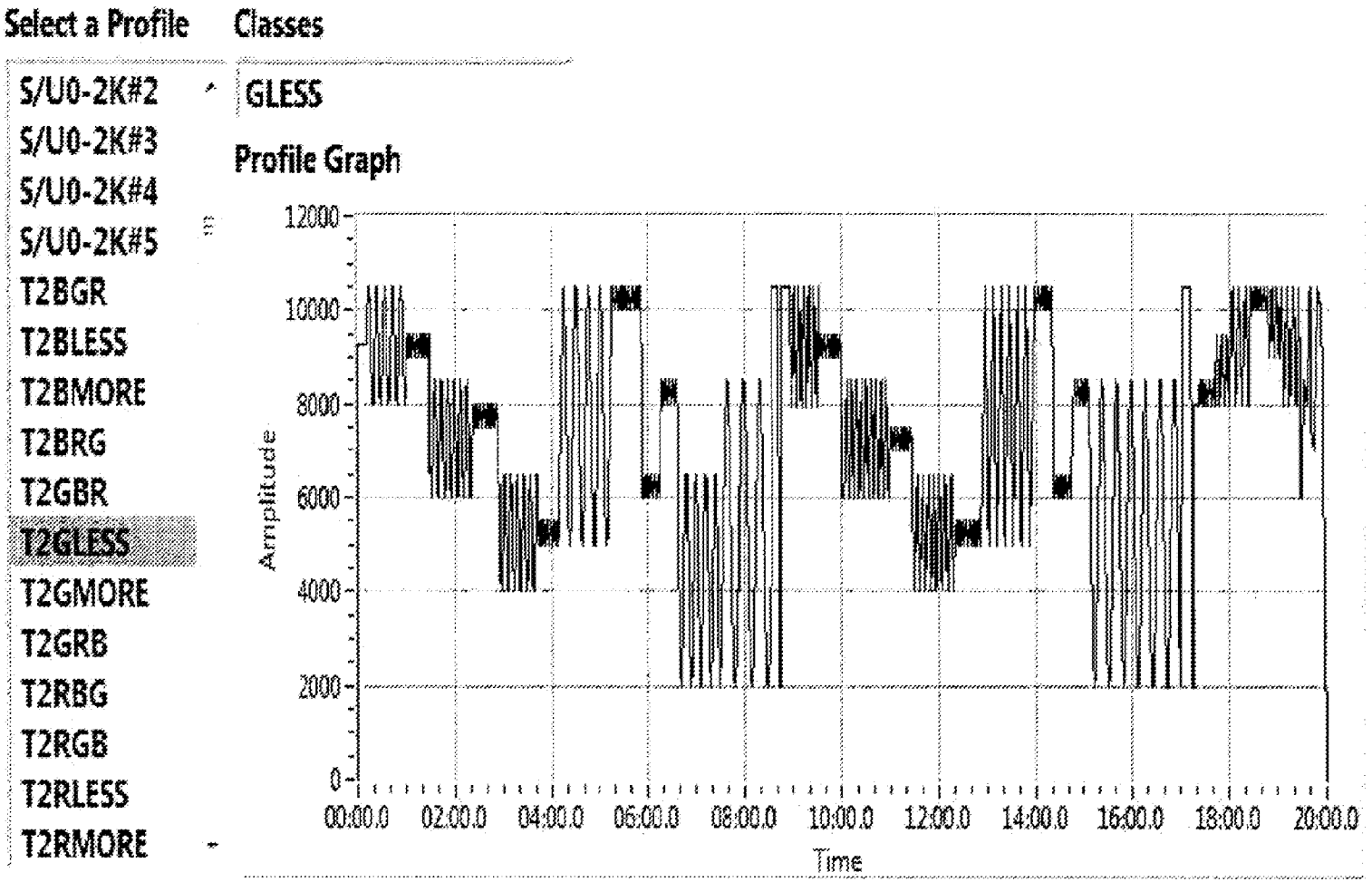
FIGS. 20-23 are graphical illustrations of various pressures applied over time during a CVAC session using profile GLESS at tiers 2 through 5, respectively.
Figure 21:
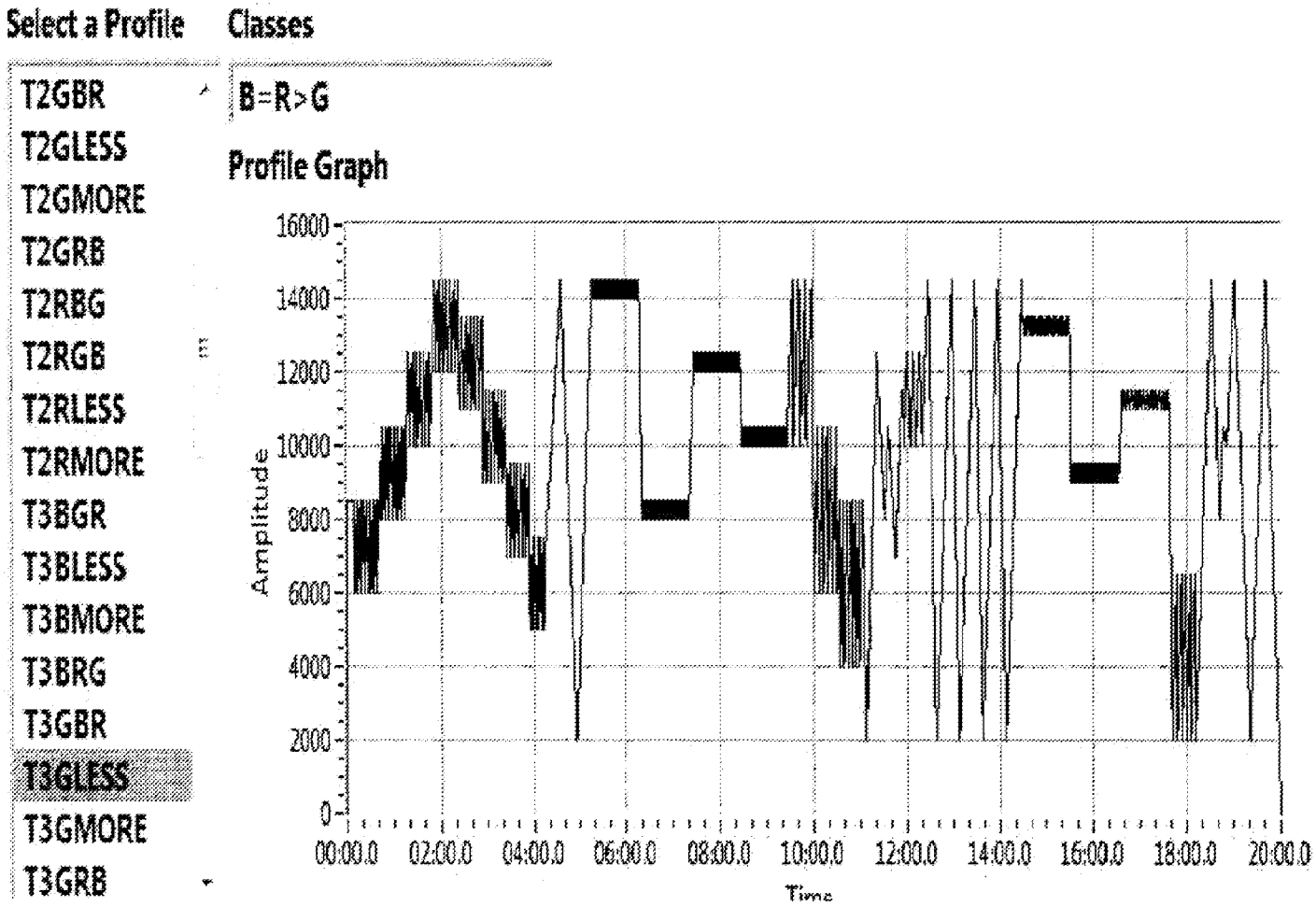
Figure 22:
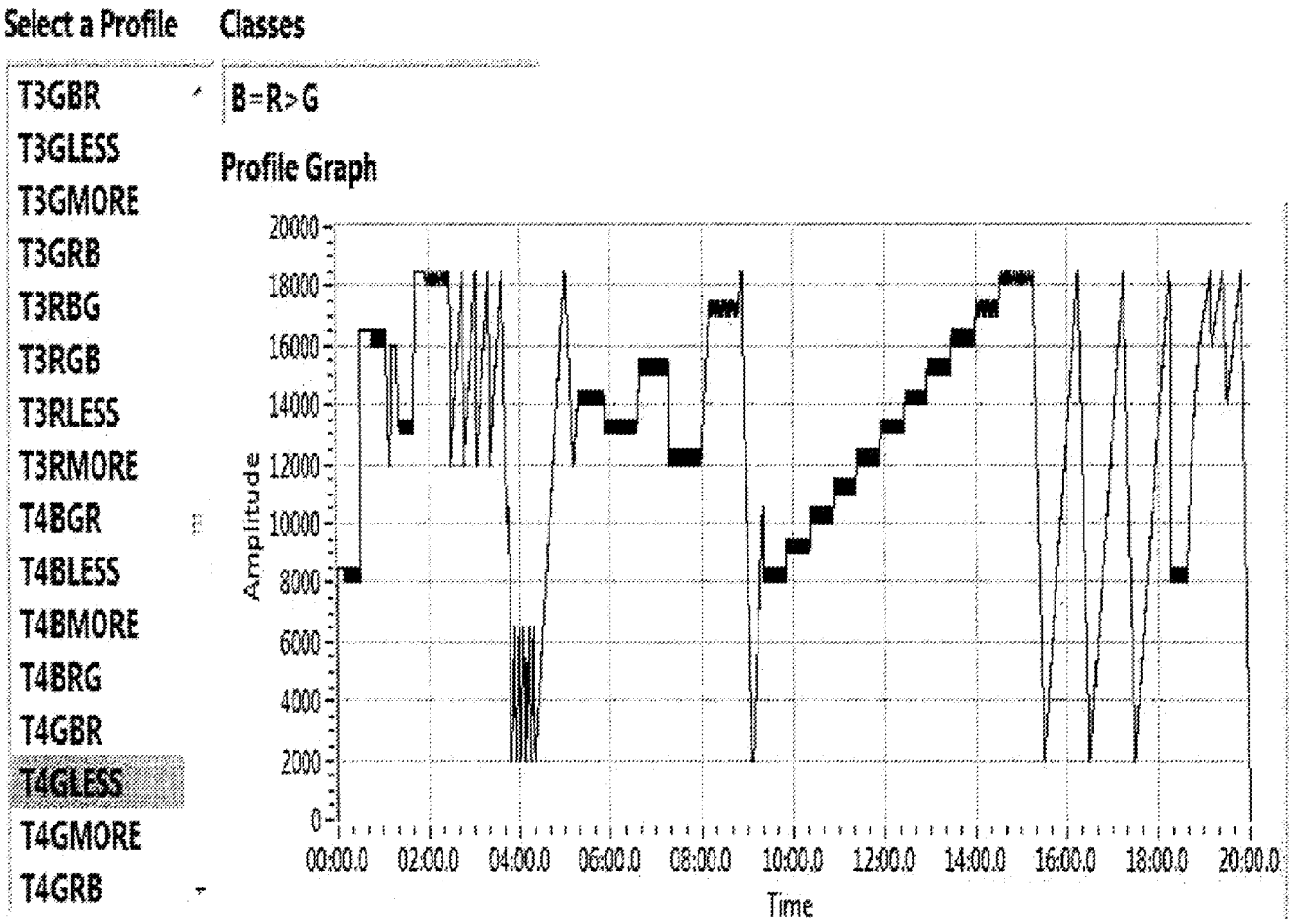
Figure 23:
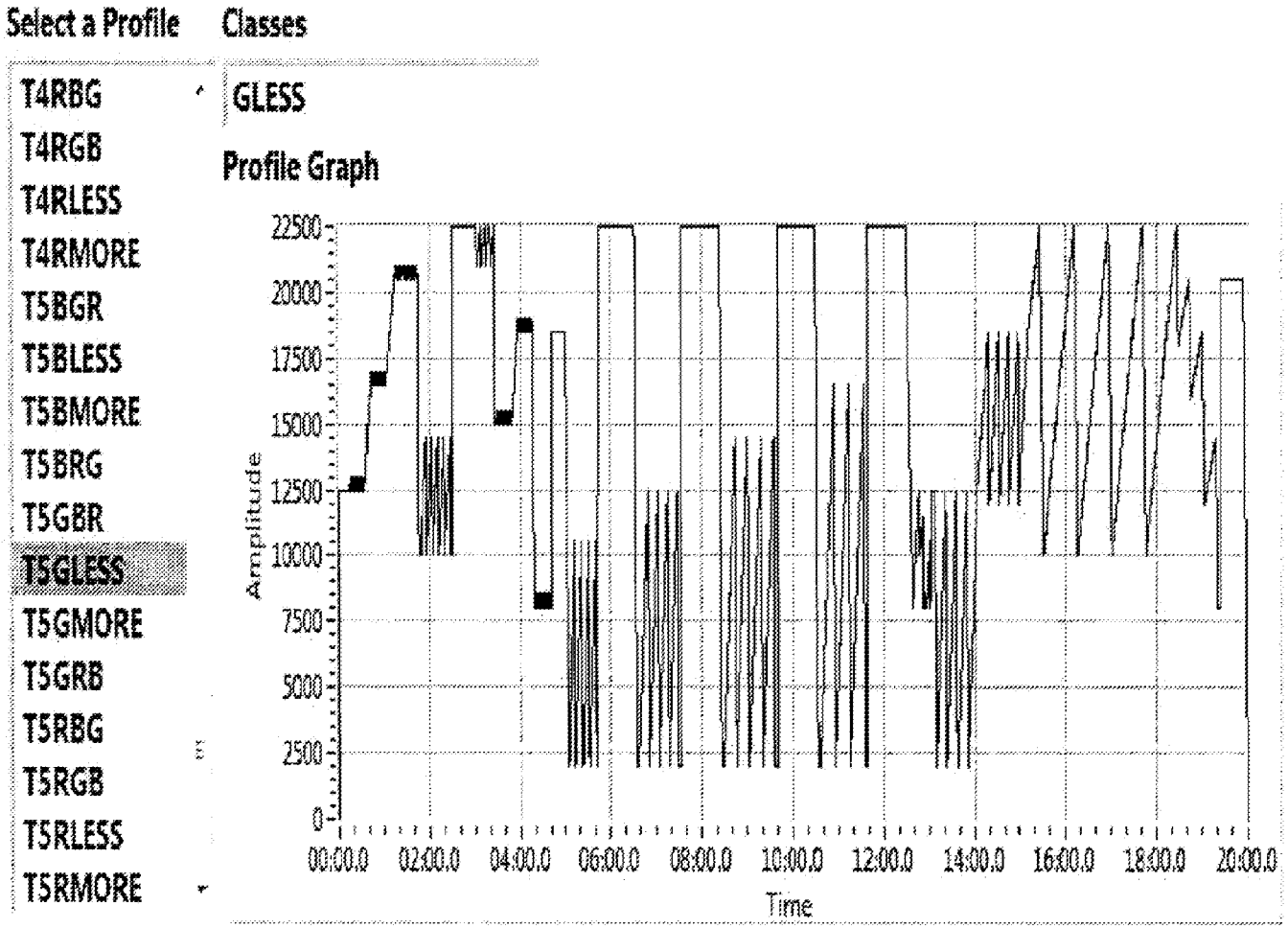
Figure 24:
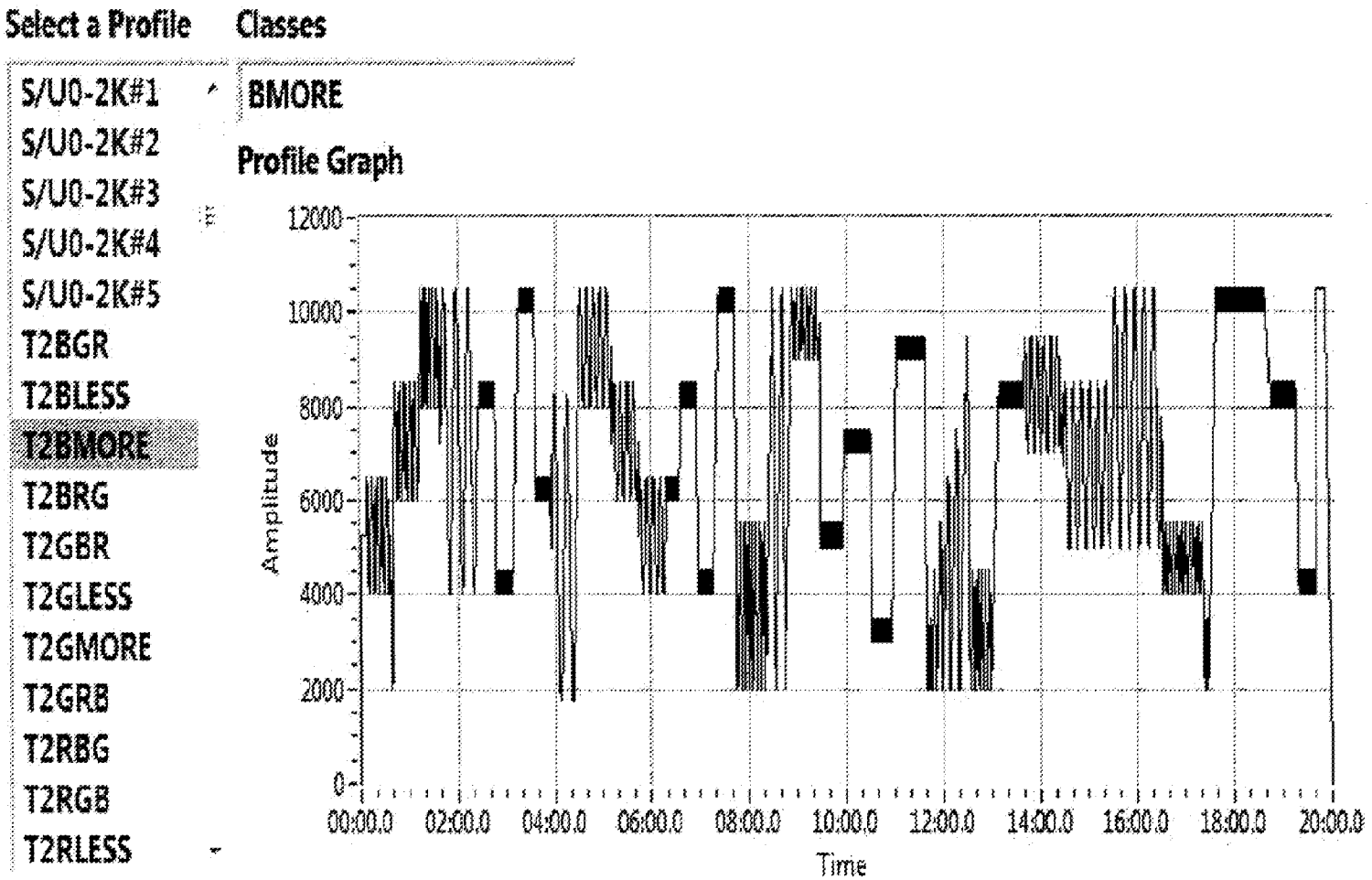
FIGS. 24-27 are graphical illustrations of various pressures applied over time during a CVAC session using profile BMORE at tiers 2 through 5, respectively.
Figure 25:
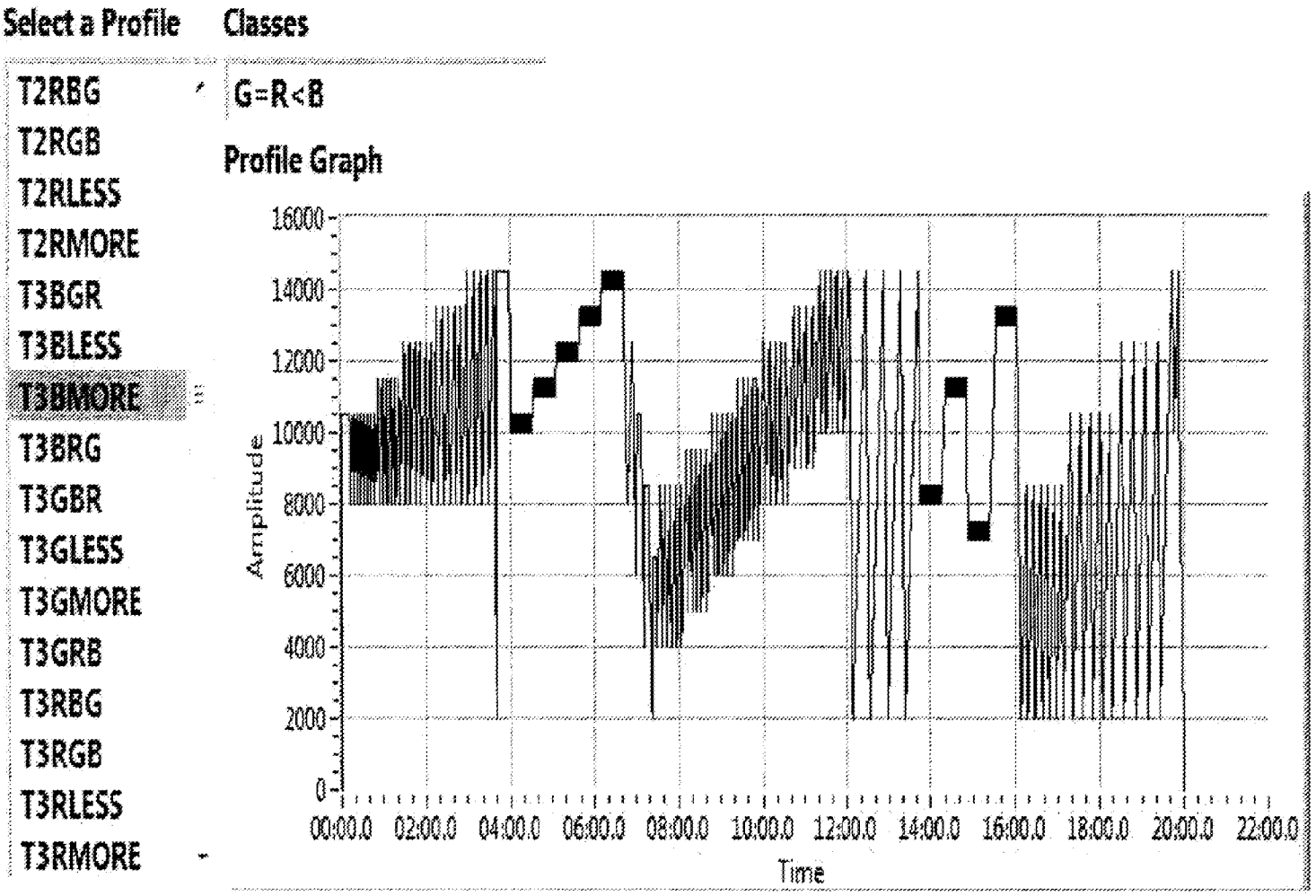
Figure 26:
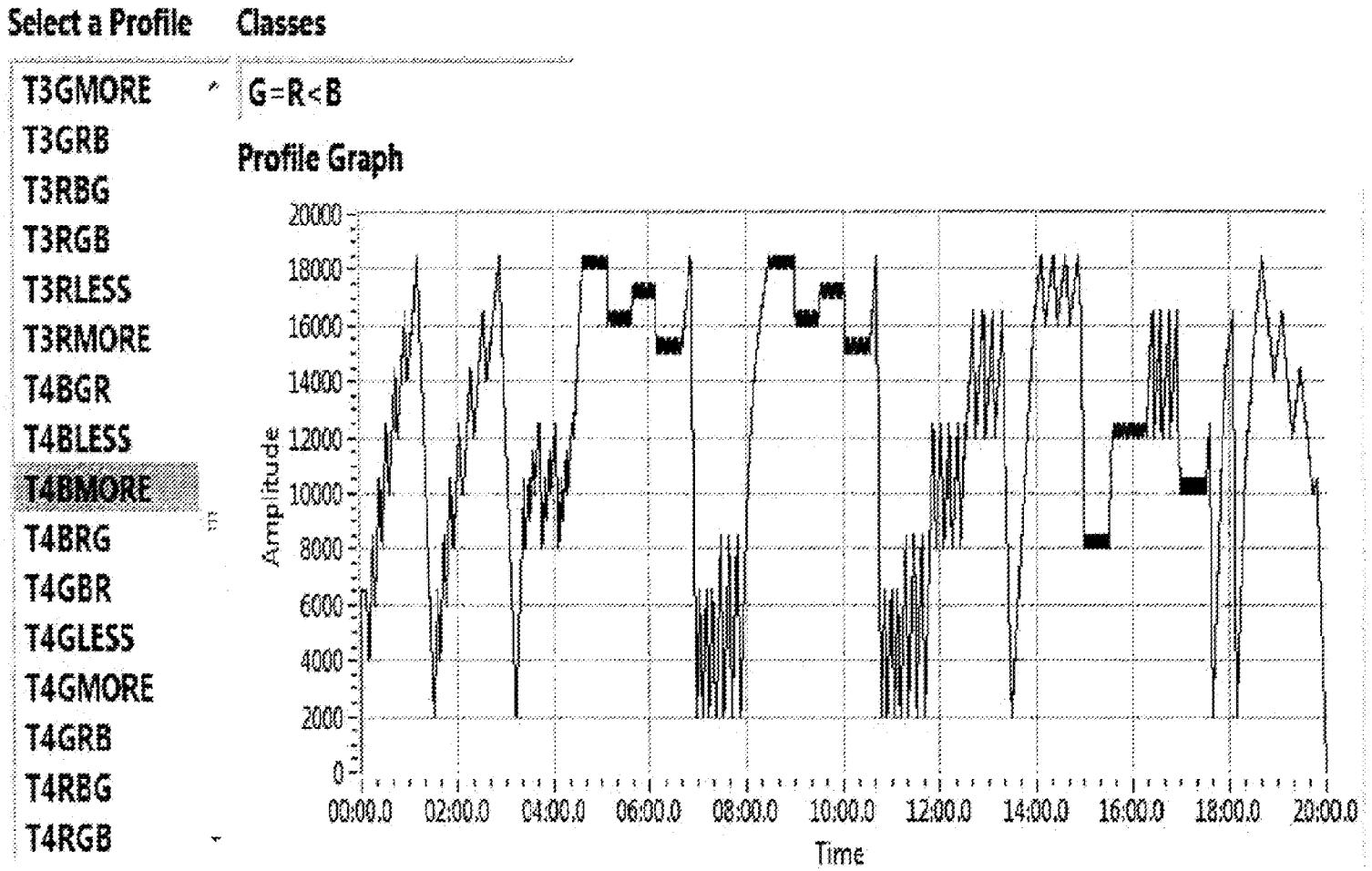
Figure 27:
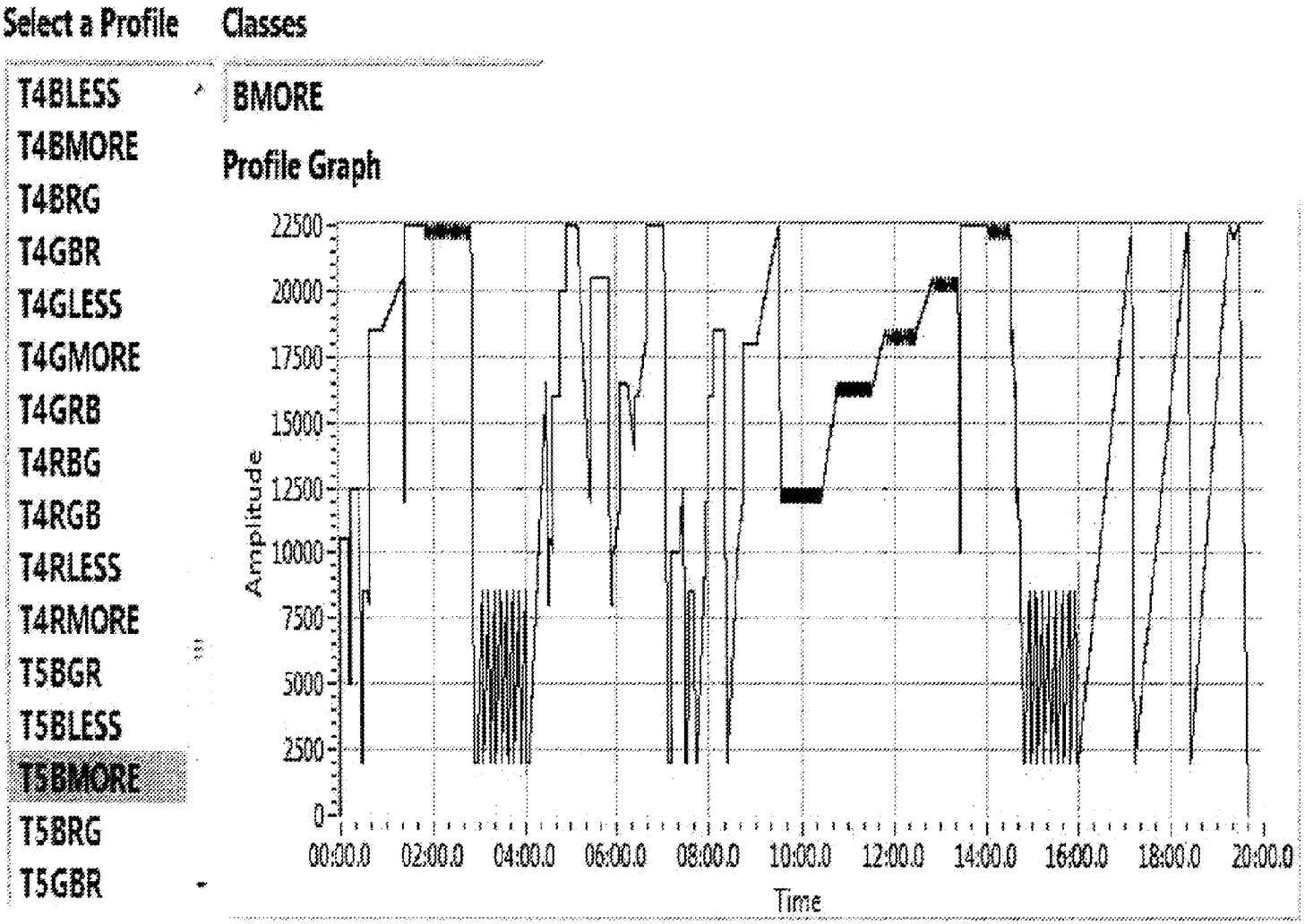
Figure 28:
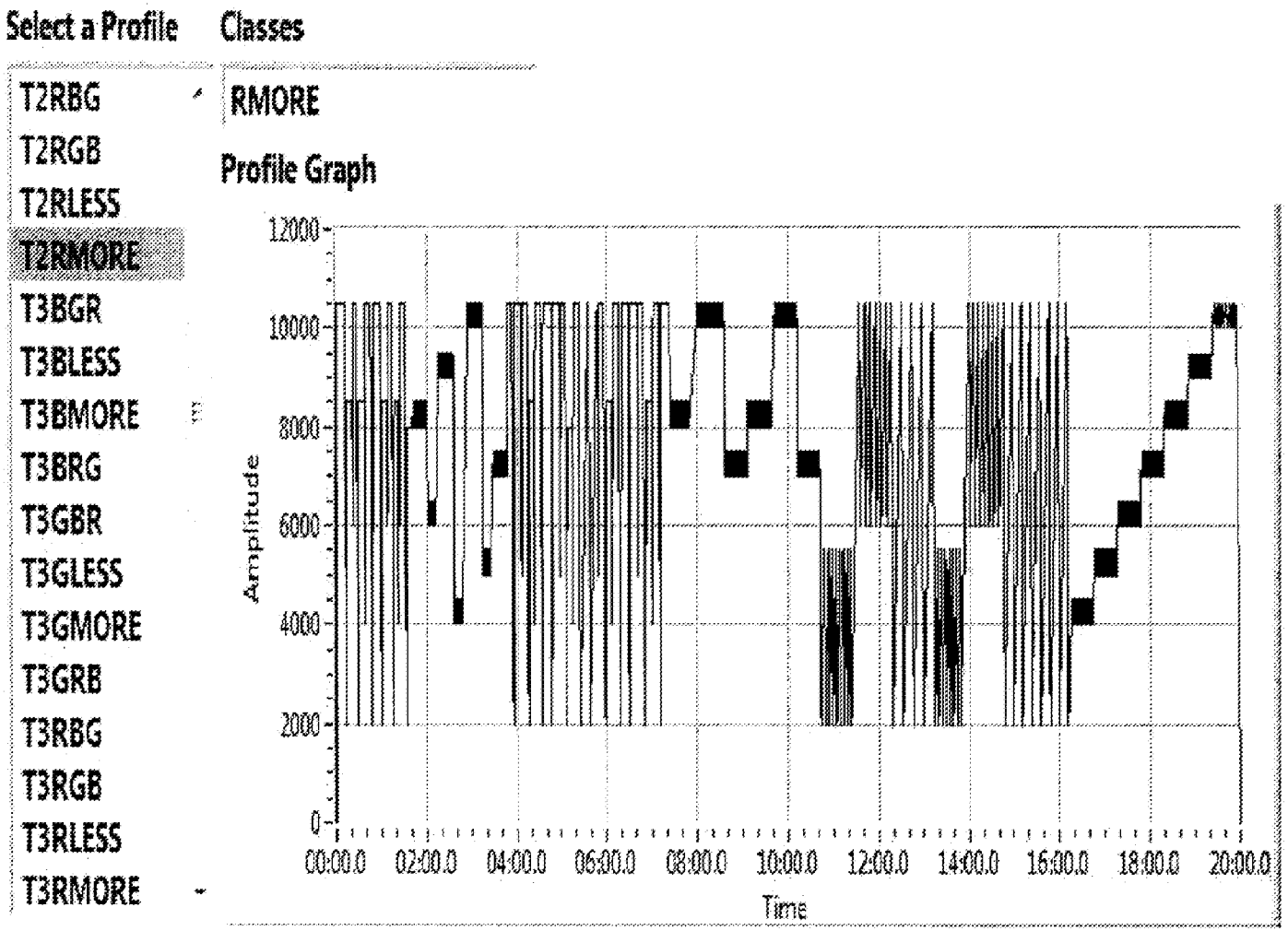
FIGS. 28-31 are graphical illustrations of various pressures applied over time during a CVAC session using profile RMORE at tiers 2 through 5, respectively.
Figure 29:
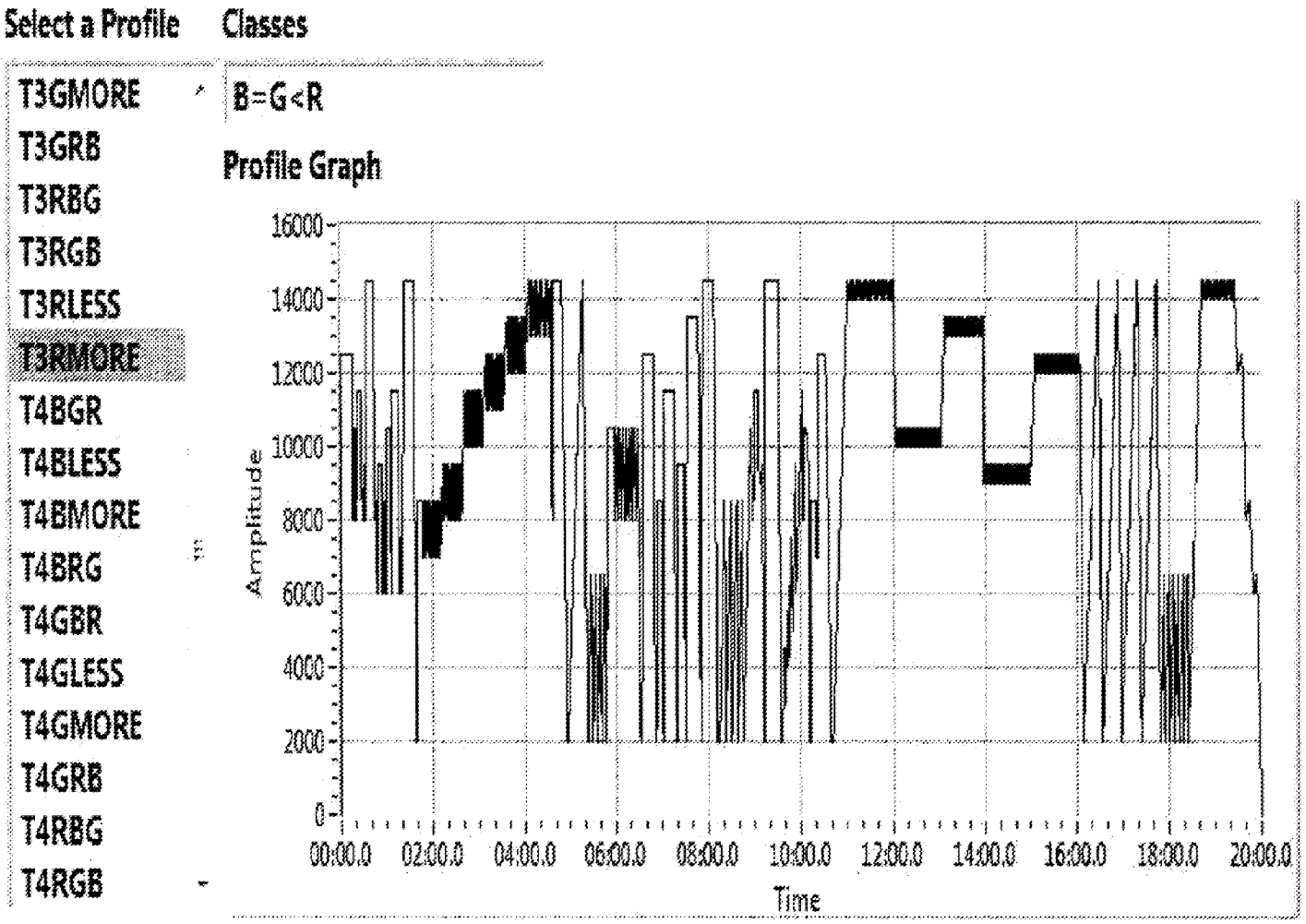
Figure 30:
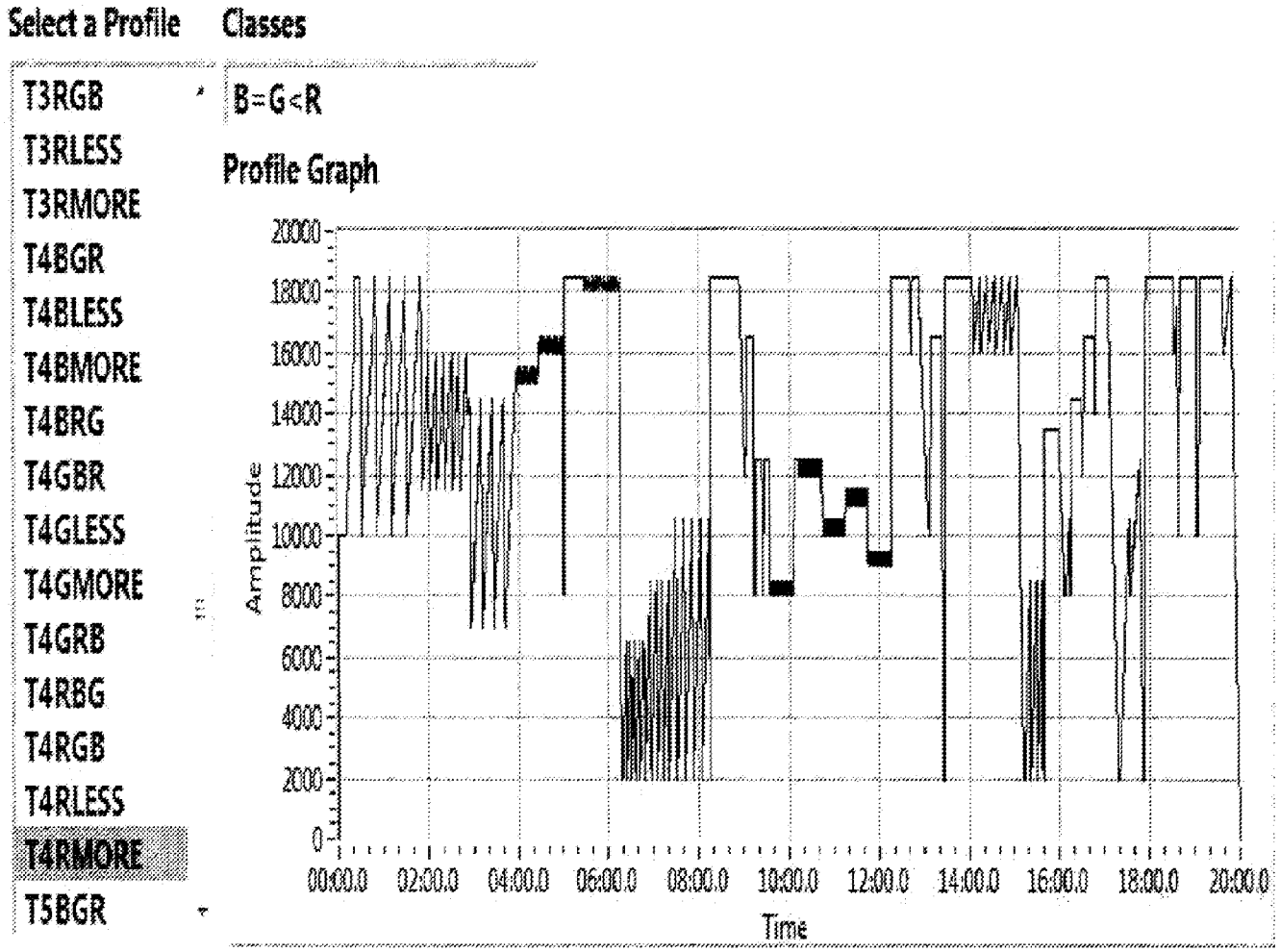
Figure 31:
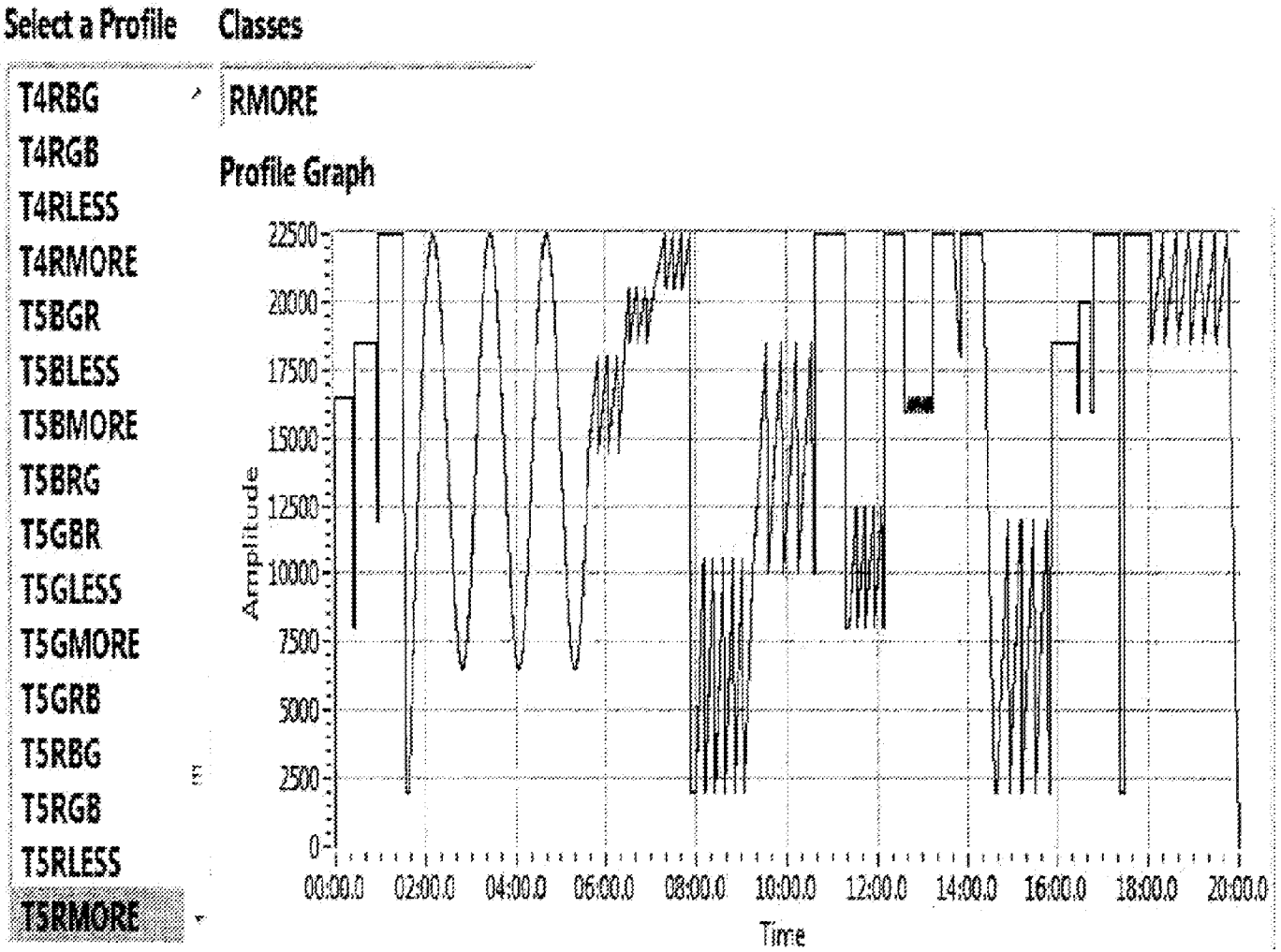

Two diabetic subjects (Type-1 and Type-2) were administered 20 minute CVAC sessions, three times a week over a 9 week period. Subject #1 was administered a rotation classified as GLESS, which comprised profiles, for tiers 2 and 3 respectively, GLESS (FIGS. 20, 21), BMORE (FIGS. 24, 25), RMORE (FIGS. 28, 29), RBG (FIGS. 5, 9), and BRG (FIGS. 4, 8). Subject #2 was administered a rotation classified as BRG, which comprised profiles BRG (FIGS. 4, 8), RBG (FIGS. 5, 9), GLESS (FIGS. 20, 21), RMORE (FIGS. 28, 29), and BMORE (FIGS. 24,25). Triglycerides (TGC), Cholesterol levels (HDL and LDL), and Hemoglobin A1c levels were assessed during the study period. Subject #1 underwent additional CVAC sessions and was additionally assessed at a 14-week time-point. Study time periods and results are shown in Table 1.

TABLE 1

| | Baseline | | 9 Weeks | | 14 Weeks | |
|---|---|---|---|---|---|---|
| Physiological Marker | Subject #1 | Subject #2 | Subject #1 | Subject #2 | Subject #1 | Subject #2 |
| Triglycerides (TGC) | 102 | 81 | 118 | 85 | 101 | n/d* |
| HDL | 49 | 72 | 49 | 76 | 49 | n/d* |
| LDL | 106 | 111 | 67 | 99 | 84 | n/d* |
| HbA1c | 6.7 | 8.4 | 6.8 | 7.6 | 7.1 | n/d* |
| (LDL + TGC)/HDL | 4.2 | 2.7 | 3.8 | 2.4 | 2.1 | n/d* |

Subject #1: Type-2 diabetic, female
Subject #2: Type-1 diabetic, male
*n/d = not determined The results from the two different subjects show a decrease in their (LDL+TGC)IHDL ratios, indicating improvement in HDL as well as reductions in LDL and/or TGC. Thus in this study, the administration of CVAC sessions resulted in a greater than 10% reduction in the (LDL+TGC)/HDL ratio in subject #2, and a 50% reduction in subject #1. Further, CVAC successfully reduced the LDL and TGC levels of both diabetic individuals, and raised the HDL levels in the diabetic individuals. Thus, in some embodiments, the application of at least one CVAC session may result in at least a 5% reduction in the (LDL+TGC)IHDL ratio, at least a 5-10% reduction in the (LDL+TGC)IHDL ratio, or greater than a 10% reduction in the (LDL+TGC)/HDL ration.

Example 3

A 36 year old male was administered CVAC sessions for 40 minutes (two twenty-minute CVAC sessions administered in immediate succession), 4 times a week for 12 weeks. In this study, the CVAC session rotation was classified as REG which included five profiles, for tiers 2-5, REG (FIGS. 5, 9, 13, and 17), BRG (FIGS. 4, 8, 12, and 16), RMORE (FIGS. 28, 29, 30, and 31), GLESS (FIGS. 20, 21, 22, and 23), and REG again. Testosterone (T) levels, total testosterone levels (TT), LDL levels (LDL), Total Cholesterol (C), and Insulin levels (1) were assessed. Results of physical markers prior to CVAC treatment and after CVAC treatment are shown in Table 2.

TABLE 2

| Physiological Marker | 3 months prior to CVAC treatment Subject #1 | 3 months after beginning CVAC treatment Subject #1 |
|---|---|---|
| Free Testosterone (T) | 80 | 177 |
| Total Testosterone (TT) | 298 | 706 |
| Total Cholesterol (C) | 275 | 258 |
| Serum LDL | 208 | 191 |
| Serum Insulin (I) | 5.0 | 2.0 |

The results of the study demonstrate that CVAC administration increased T levels while also decreasing LDL, C, and I. Specifically, LDL was reduced by 9%, T was increased by 121%, TT was increased by 58%, and I was reduced by 60%. Thus, in some embodiments, the application of at least one CVAC session may result in at least a 10% increase in T, at least a 20% increase in T, at least a 30% increase in T, at least a 40% increase in T, at least a 50% increase in T, at least a 75% increase in T, at least a 100% increase in T, or greater than a 100% increase in T. Similarly, the application of at least one CVAC session may result in at least a 1% reduction in LDL, at least a 2% reduction in LDL, at least a 3% reduction in LDL, at least a 4% reduction in LOL, at least a 5% reduction in LOL, at least a 10% reduction in LOL, or greater than a 10% reduction in LDL. The application of at least one CVAC session may further result in at least a 1% reduction in serum insulin, at least a 5% reduction in serum insulin, at least a 10% reduction in serum insulin, at least a 20% reduction in serum insulin, at least a 30% reduction in serum insulin, at least a 60% reduction in serum insulin, or greater than a 60% reduction in serum insulin.

Example 4

Effect of CVAC exposure of 40 minutes twice a week on endogenous testosterone. Six subjects (S-1, S-3, S-6, M-9, M-18, and M-23) and a control subject (M-14) are administered two twenty-minute CVAC sessions, administered in immediate succession, twice a week throughout the study period. The CVAC sessions experienced by each subject included a profile of pressure levels and durations for each pressure level. There were three different profiles used in the study, entitled BRG, RBG, and GRB' Each CVAC session profile cycled through a rotation of the pressures and parameters associated with that given profile. After completing three 20-minute CVAC sessions including a given profile, each subject then switched to a second CVAC session profile. The subjects then experienced three CVAC sessions of this second profile before switching to the third CVAC session profile. After completion of three CVAC sessions based on the third profile, the subject then returned to the first profile, with each profile be repeated in triad form. All CVAC sessions, regardless of the profile used, had a pressure ceiling corresponding to a specific tier. Subjects then progressed through tiers 2-5, and each tiered level included a maximum pressure ceiling that corresponded to an altitude of 4000 feet higher than the previous tier. A subject was not allowed to switch to the next higher tier until the subject had experienced fifteen CVAC sessions at the lower tier. Sham sessions (or control sessions) correspond to the cycling of the five tier levels but do not contain any meaningful pressure changes (e.g. pressure changes equivalent to altitude of 2000 feet with very few changes in duration), thus the subjects experience the CVAC session for the equivalent 20 minute session, but without the pressure changes and durations. In this study, profiles BRG (FIGS. 4, 8, 12, and 16), RBG (FIGS. 5, 9, 13, and 17), GRB (FIGS. 6, 10, 14, and 18) (tiers 2-5 respectively) were administered in sequential order for tiers 2-5 as described above. Sham sessions corresponding to tiers 2, 3, 4, and five (FIGS. 7, 11, 15, and 19) were administered where indicated and the graphical representations corresponding to pressures are not indicative of the pressure changes in the CVAC unit. The simulated graphical output was for control purposes to keep the subjects blinded to the sham sessions.

Blood samples were drawn prior to beginning the study period and after the final CVAC session at the end of the study period. Blood samples were analyzed for total testosterone, free testosterone, and the ratio of total testosterone to free testosterone. Results are shown in FIG. 3.

Example 5

Effect of CVAC exposure of 40 minutes twice a week on serum lipid levels. Six subjects (S-I, S-3, S-6, M-9, M-18, and M-23) and a control subject (M-14) are administered two twenty-minute CVAC sessions, twice a week for throughout the study period. The CVAC sessions experienced by each subject included a profile of pressure levels and durations for each pressure level. There were three different profiles used in the study, entitled BRG, RBG, and GRB. Each CVAC session profile cycled through a rotation of the pressures and parameters associated with that given profile. After completing three 20-minute CVAC sessions including a given profile, each subject then switched to a second CVAC session profile. The subjects then experienced three CVAC sessions of this second profile before switching to the third CVAC session profile. After completion of three CVAC sessions based on the third profile, the subject then returned to the first profile, with each profile be repeated in triad form. All CVAC sessions, regardless of the profile used, had a pressure ceiling corresponding to a specific tier. Subjects then progressed through tiers 2-5, and each tiered level included a maximum pressure ceiling that corresponded to an altitude of 4000 feet higher than the previous tier. A subject was not allowed to switch to the next higher tier until the subject had experienced fifteen CVAC sessions at the lower tier. Sham sessions (or control sessions) correspond to the cycling of the five tier levels but do not contain any meaningful pressure changes (e.g. pressure changes equivalent to altitude of 2000 feet with very few changes in duration), thus the subjects experience the CVAC session for the equivalent 20 minute session, but without the pressure changes and durations. In this study, profiles BRG (FIGS. 4, 8, 12, and 16), RBG (FIGS. 5, 9, 13, and 17), GRB (FIGS. 6, 10, 14, and 18) (tiers 2-5, respectively) were administered in sequential order for tiers 2-5 as described above. Sham sessions corresponding to tiers 2, 3, 4, and 5 (FIGS. 7, 11, 15, and 19) were administered where indicated and the graphical representations corresponding to pressures are not indicative of the pressure changes in the CVAC unit. The simulated graphical output was for control purposes to keep the subjects blinded to the sham sessions.

Blood samples were drawn prior to beginning the study period and after the final CVAC session at the end of the study period. Blood samples are analyzed for a variety of serum lipid levels including HDL, VLDL, and LDL. The results are summarized in FIG. 2.

Example 6

During the foregoing studies listed in Examples 1 through 5, data was also recorded based on reports by participants of improved sensation and/or decreased pain as a result of one or more CVAC sessions. Specifically, such data was recorded for eight participants previously diagnosed with diabetic peripheral neuropathy. The participants reported a maximum pre-CVAC pain score within the range of 4-8 (of the eight, two participants did not report a maximum pre-CVAC pain score). Following one or more CVAC sessions, the participants reported a maximum post-CVAC pain score within a range of 0-3 (the two participants not reporting a maximum pre-CVAC pain score also did not report a maximum post-CVAC pain score). An increase or improvement in sensation was noted by the participants after one to five CVAC sessions. A decrease in pain was perceived by the participants after one to twenty-four CVAC sessions. For six of the eight participants for which data is available, four verbally reported an improvement in pain of 100%, suggesting a total alleviation of pain, and two participants verbally reported an improvement in pain of 50%, suggesting a significant alleviation of pain. Details of the participants and individualized data is set out in Table 3, below:

TABLE 3

| Participant | Sex[1]/ Race[2] | Diagnosis[3]/ Year | Verbal Pain Descriptor | Max pre-CVAC Pain Score | No. of Sessions to Improved Sensation | No. of Sessions to Decreased Pain | Max post-CVAC Pain Score | % Pain Improved Verbally | Max. altitude (in feet) |
|---|---|---|---|---|---|---|---|---|---|
| 1 | M/C | DPN, 2002 | Pins and Needles | 6 | 1 | 6 | 3 | 50% | 22,500 |
| 2 | M/C | DPN/Foot Ulcers, 2008 | Burning | 6 | 3 | 5 | 3 | 50% | — |
| 3 | M/C | DPN, 1993 | Stabbing | 4 | 1 | 1 | 0 | 100% | 16,000 |
| 4 | M/C | DPN/Bilateral BKA, 1993 | Burning | 6 | 4 | 12 | 0 | 100% | 15,000 |
| 5 | F/C | DPN, 2005 | N/A | N/A | 3 | N/A | N/A | N/A | 20,000 |
| 6 | F/C | DPN, 2004 | Burning | 6 | 1 | 24 | 0 | 100% | — |
| 7 | M/C | DPN, 2007 | Stabbing & Burning to knees | 8 | 5 | 12 | 0 | 100% | — |
| 8 | M/B | DPN, 2000 | Severe | N/A | 4 | 4 | N/A | N/A | 18,500 |

[1]"M" refers to male, "F" refers to female
[2]"C" refers to Caucasian, "B" refers to Black or African-American
[3]"DPN" refers to diabetic peripheral neuropathy, "BKA" refers to below-the-knee amputation Example 7

Data was collected in three men aged between 50 to 64 years of age, each of which was diagnosed with type 2 diabetes for two years or more and with diabetic peripheral neuropathy for six months or more. Each of the three participants received a series of CVAC sessions using one or more of the program profiles described herein.

Prior to receiving a CVAC session, a first male participant reported experiencing 100% bilateral loss of sensation from his knees to his toes, and pain in both feet. The first participant received three, forty minute CVAC sessions over a period of six weeks. Following the CVAC sessions, the first participant experienced restoration of sensory function in about four inches of his lower legs and 100% elimination of pain.

Prior to beginning a CVAC session, a second male participant, sixty-four years old, reported experiencing "pins and needles" type pain in the whole bottom of his foot, which he scored as 5-6 on a pain scale of 10. The second participant also reported decreased sensation along the bottom of his feet, a minor decrease in sensation on the top of his foot, and loss of sensation on all toes in both feet. The second participant was exposed to a first twenty-five minute CVAC session and then about sixty, twenty minute CVAC sessions. After the first CVAC session, the second participant reported noticing a return of some sensation in his lower limbs. After about sixty, twenty minute CVAC sessions, sensation returned primarily in the second participant's arch, heels, and toes, which sensation in the arch being restore to an estimated 100% of feeling. The second participant noted neuropathy remained in the ball of at least one foot, but that pain decreased to about 2-3 on the pain scale of 10.

Prior to beginning a CVAC session, a third male participant, sixty years old, reported 100% bilateral loss of sensation from his knees to his toes, but no pain in either limb. The third participant received a first forty-five minute CVAC session and about five, twenty-minute CVAC sessions. Following the first forty-five minute CVAC session, the third participant noticed a return of sensation, commenting that he could feel the socks on his feet. The return of sensation remained for about two to three days after receiving the CVAC session. After receiving the about five, twenty-minute CVAC sessions, the third participant noted complete return of bilateral sensation in his feet and legs. The returned sensation remains, and the individual continues a weekly CVAC program.

Example 8

Ten participants diagnosed with adiposis dolorosa completed a study on the use of the CVAC methodology to improve pain associated with the adiposis dolorosa disorder. The participants included four men and six women, having an average age of 48±3.6 years and a range of 31 to 72 years old. All participants were non-Hispanic Caucasians, except for one male Hispanic. The average weight of participants was 88.7±8 kg, and the body mass index was 28.3±1.8 kg/m$^2$. Half of the participants also carried a diagnosis of fibromyalgia.

The participants each received an initial CVAC session of twenty-five minutes on the day one and two twenty-minute CVAC sessions on days two through five. Each CVAC session included between about 300 and about 500 cyclic altitude changes in a twenty (or twenty-five) minute period, with an average rate of change of 30.5 meters per second (m/s). The approximate cumulative change within a twenty minute session was about 365,760 meters. The cyclic altitude changes were controlled by the automated CVAC system. The dynamic changes in altitude result in a pulsatile effect of pressure on the participants. On day one of the study, participants received the CVAC session in five stages, which collectively are Tier 1. Each of the five stages of Tier 1 was five minutes in duration. The maximum altitude for Tier 1 was 3,200 meters. One each of days two through 5, the participants received up to two twenty minute CVAC sessions on Tier 2, also with a maximum altitude of 3,200 meters. The average altitude for the CVAC sessions over the five day period was about 1, 828 meters. One participant only completed one CVAC session per day of the five day study and another participant only completed eight CVAC sessions over the five day study due to difficulty in equilibrating ear pressure.

On days one and five of the study, participants completed a questionnaire regarding pain severity, a scale for pain-related symptoms, a pain disability index, and a quality of life index. Each day of the study, participants completed a scale of pain severity. Following the CVAC sessions, the participant's current pain severity significantly decreased from 3.1±0.3 to 2.0±0.2 from a total of 5. The participants scores on the pain-related symptoms scale also significantly decreased on day five from day one from a score of 28.2±3.5 to a score of 25.2±2.9. The post-CVAC sessions also resulted in significantly reduced average, highest, and lowest pain levels on day five compared to day 1. Specifically, the average pain level was reduced from 5.6±0.6 to 4.2±0.6, the highest pain level was reduced from 7±0.7 to 5.7±0.7, and the lowest pain level was reduced from 4.4±0.5 to 3.4±0.4. Both the average level and lowest level of the daily scale for measuring pain severity showed both a significant linear decrease across the five days and quadratic patterns of change (flatter pain averages in the first days followed by larger decreases later) over the five day study. The highest level of the daily scale for measuring pain severity showed a significant linear decrease over the five days. As such, the five day study shows that the CVAC process, which includes cyclic pneumatic hypobaric compressions administered by a high-performance altitude simulator, results in decreased pain in people with adiposis dolorosa, and may also help in treating other chronic pain disorders.

The aspects and embodiments of the present invention described above are only examples and are not limiting in any way. Various changes, modifications or alternations to these embodiments may be made without departing from the spirit of the invention and the scope of the claims.

What is claimed is:

1. A method, comprising:

administering at least two Cyclic Variations in Altitude Conditioning (CVAC) sessions to a mammal having chronic pain disposed in a pressure vessel unit, the at least two CVAC sessions each having a duration of at least twenty minutes, and including a start point of ambient pressure at a delivery site, an end point of ambient pressure at the delivery site, and a plurality of atmospheric pressure targets executed between the start point and the end point, the administering being configured to treat the chronic pain.

2. The method of claim 1, wherein the mammal is wholly disposed within the pressure vessel unit.

3. The method of claim 1, further comprising:

measuring, after the administering, at least one parameter associated with chronic pain, the at least one parameter including a measure of feeling, pain severity, pain-related symptoms, or quality of life of the mammal.

4. The method of claim 3, further comprising:

measuring an efficacy of the at least two CVAC sessions based on a change to the at least one parameter prior to and after the administering.

5. The method of claim 1, wherein each of the plurality of pressure targets is equivalent to a pressure in a range of about 2,000 feet and 22,500 feet above atmospheric pressure.

6. The method of claim 1, wherein each of the plurality of pressure targets is equivalent to a pressure in a range of about 1,000 feet and 11,000 feet above atmospheric pressure.

7. The method of claim 1, wherein at least one of the two CVAC sessions includes a first tier of five stages, each stage of the five stages being five minutes in duration.

8. The method of claim 1, wherein a first session of the at least two CVAC sessions has a duration of twenty-five minutes, a second session of the at least two CVAC sessions has a duration of twenty minutes.

9. The method of claim 1, wherein the plurality of atmospheric pressure targets includes a first atmospheric pressure target of a first atmospheric pressure executed after the start point, a second atmospheric pressure target of a second atmospheric pressure lower than the first atmospheric pressure and executed after the first atmospheric pressure, and a third atmospheric pressure target of a third atmospheric pressure higher than the second atmospheric pressure, the third atmospheric pressure target executed after the second atmospheric pressure target and before the end point.

* * * * *